US008337354B2

(12) United States Patent
Okabe et al.

(10) Patent No.: US 8,337,354 B2
(45) Date of Patent: Dec. 25, 2012

(54) LUBRICATOR IN POWER TRANSMISSION SYSTEM OF MARINE PROPULSION UNIT

(75) Inventors: Yoshihiko Okabe, Shizuoka (JP); Hirotoshi Yamauchi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 931 days.

(21) Appl. No.: 12/413,675

(22) Filed: Mar. 30, 2009

(65) Prior Publication Data

US 2010/0248564 A1 Sep. 30, 2010

(51) Int. Cl.

| | |
|---|---|
| ***F16H 57/04*** | (2010.01) |
| ***B63H 20/14*** | (2006.01) |
| ***B63H 23/04*** | (2006.01) |
| ***B63H 23/30*** | (2006.01) |

(52) U.S. Cl. ..... 475/159; 184/6.12; 440/75

(58) Field of Classification Search ..... 475/159, 475/160; 184/6.12; 440/75

See application file for complete search history.

(56) References Cited

U.S. PATENT DOCUMENTS

| | | | | |
|---|---|---|---|---|
| 7,704,183 | B2 * | 4/2010 | Nakamura et al. | 475/312 |
| 7,727,037 | B2 * | 6/2010 | Fukuoka et al. | 440/88 L |
| 7,798,874 | B2 * | 9/2010 | Fukuoka | 440/75 |
| 7,811,141 | B2 * | 10/2010 | Fukuoka | 440/75 |
| 8,157,694 | B2 * | 4/2012 | Nakamura et al. | 475/269 |
| 2008/0023923 | A1 * | 1/2008 | Kameyama et al. | 277/595 |
| 2008/0070739 | A1 | 3/2008 | Nakamura et al. | |
| 2009/0203272 | A1 * | 8/2009 | Okabe | 440/75 |
| 2009/0203492 | A1 * | 8/2009 | Okabe | 475/331 |

FOREIGN PATENT DOCUMENTS

WO 2007/007707 A1 1/2007

* cited by examiner

*Primary Examiner* — David D Le
*Assistant Examiner* — Jacob S Scott
(74) *Attorney, Agent, or Firm* — Keating & Bennett, LLP

(57) ABSTRACT

A power transmission system of a marine propulsion system includes a transmission arranged to change the speed of an output from an engine and then to transmit the output to a propeller shaft. Wet-type multi-plate clutches provided in the transmission include a plurality of clutch plates fitted to a clutch rotating body for axial movement with the clutch rotating body. The clutch rotating body includes an oil reservoir in its inner bottom portion and arranged to hold lubricating oil and a peripheral wall arranged to cover the oil reservoir from the radial outside and fit to each of the clutch plates to permit axial movement of the clutch plates. Communicating holes are arranged on the peripheral wall such that they communicate the oil reservoir side to the outside of the clutch rotating body in the radial direction.

17 Claims, 17 Drawing Sheets

| Part name (reference no.) | ○: Clutch engaged | | ×: Clutch disengaged | | |
|---|---|---|---|---|---|
| First clutch (66) | × | ○ | × (○) | × | ○ |
| Second clutch (67) | × | × | × | ○ | ○ |
| Third clutch (68) | ○ | ○ | × | × | × |
| One-way clutch (75) | Reverse rotation inhibited | Normal rotation permitted | Reverse rotation inhibited (Normal rotation permitted) | Reverse rotation inhibited | Normal rotation permitted |
| Speed change state | Slow forward travel | Fast forward travel | Neutral | Slow reverse travel | Fast reverse travel |

FIG. 17

LUBRICATOR IN POWER TRANSMISSION SYSTEM OF MARINE PROPULSION UNIT

BACKGROUND OF THE INVENTION

1. Field of the Invention

The present invention relates to a power transmission system of a marine propulsion unit that receives an engine output, changes the speed of the output, and transmits the output to a propeller shaft. More specifically, the present invention relates to a lubricator in the power transmission system and an oil supply device arranged to supply lubricating oil to the lubricator.

2. Description of the Related Art

A conventional marine propulsion unit is disclosed in WO 2007/007707. According to WO 2007/007707, the marine propulsion unit includes a case which is disposed immediately behind a hull and supported at the rear of the hull, a propeller supported in a lower portion of the case, and a transmission unit housed in the case to receive an engine output, change the speed of the output, and transmit the output to the propeller.

In an attempt to propel a boat, if the transmission unit of the power transmission system receives the engine output, the speed of the output is changed to a desired state in the transmission unit based on a speed change operation by a crew member and is transmitted to the propeller. Then, the boat travels at a speed corresponding to the speed of the propeller.

The marine propulsion unit is provided with a lubricator for lubricating the transmission unit and with an oil supply device for supplying lubricating oil to the lubricator. In the oil supply device, an oil pump is activated by a driving force of an input-side shaft. The oil supply device controls oil from the oil pump with a control valve and supplies the oil to each clutch.

In a case where a multiplate clutch is used in the transmission, a majority of the oil, which is adhered to the clutch for lubrication, tends to flow down if the marine propulsion unit remains off for a long period of time. Accordingly, each clutch plate of the clutch is immediately lubricated at startup of the engine after a long period of being off. However, this causes a possible shortage in the lubricating oil for each of the clutch plates. To make matters worse, repetition of the above operation creates an undesirable problem on an operating life of each of the clutch plates, such as deterioration thereof at an early stage.

In addition, in a case where a plurality of planetary gears disposed one above the other in the transmission are used, the oil supplied to an upper planetary gear train flows down toward a lower planetary gear train that is located below the upper planetary gear train after lubricating the upper planetary gear train.

Therefore, part of the oil, which flows down from the upper planetary gear train, is supplied to rotating bodies of the lower planetary gear train, such as a sun gear and a ring gear, and possibly makes an unnecessary linkage rotation following these rotating bodies. This linkage rotation results in undesired resistance against the operation of the power transmission system of the marine propulsion unit, and possibly causes a power loss in the engine and a decline in fuel efficiency.

Meanwhile, in the above conventional art, an upper portion of the case of the marine propulsion unit is supported in a rear portion of the hull in a manner that a lower portion of the case can be tilted (rotated upward to the rear) along with the propeller. Then, during propulsion of the boat, the case is tilted during boat handling. However, if the case is tilted as described above, the oil tends to be concentrated in a front portion of the transmission unit, which is also tilted jointly, and become short in other portions of the transmission unit. Due to the above reason, a difficulty in stable oil suction by the oil pump may arise at tilting. In such a case, the lubrication in the transmission unit is undesirably inhibited.

SUMMARY OF THE INVENTION

In a first preferred embodiment of the present invention, a marine propulsion unit includes a case supported by a hull; a propeller shaft supported in a lower portion of the case; a transmission housed in the case to receive an engine output, to change the speed of the output, and to transmit the output; and a transfer device to transfer the output of the transmission to the propeller shaft. The marine propulsion unit further includes a clutch rotating body preferably including a wet-type multiplate clutch that is provided in the transmission and rotatable about an axis extending in a vertical direction; and a plurality of clutch plates fitted to the clutch rotating body for axial movement with the clutch rotating body and arranged to be engaged with and disengaged from each other by this movement. In the power transmission system of the marine propulsion unit, the clutch rotating body preferably includes an oil reservoir holding lubricating oil arranged in its bottom portion, and a peripheral wall that covers the oil reservoir from the outside in a radial direction and fits to each of the clutch plates for the axial movement of the clutch plates. A communicating hole that communicates from the oil reservoir side to the outside of the clutch rotating body in the radial direction is arranged in the peripheral wall of the clutch rotating body.

Due to the above arrangement, the oil is stored in the oil reservoir. Thus, even when the engine is activated after a long stopped period of the marine propulsion unit, in conjunction with rotation of the clutch rotating body that interlocks with the engine, the oil in the oil reservoir is immediately splashed outwardly in the radial direction from the oil reservoir due to centrifugal force. Then, the oil passes the communicating hole, is directed to the clutch plates located outside the peripheral wall of the clutch rotating body in the radial direction, and immediately and sufficiently lubricates the clutch plates. Therefore, the deterioration of each of the clutch plates at an early stage is prevented.

In a second preferred embodiment of the present invention, the clutch rotating body preferably has a bowl shape that opens upward. The oil reservoir is arranged in the bottom portion of the clutch rotating body, and a plurality of the communicating holes is defined in the peripheral wall of the clutch rotating body.

Accordingly, the clutch rotating body employs a simple structure having a bowl shape that opens upward. Also, the structure of this clutch rotating body is used to define the oil reservoir. Therefore, the lubrication of each of the clutch plates can be carried out in a simple arrangement. In addition, since the plurality of communicating holes is provided in the peripheral wall of the clutch rotating body, each of the clutch plates is lubricated evenly with the oil that passes through each of the communicating holes and is directed toward each of the clutch plates. Therefore, the deterioration of the clutch plates is totally prevented.

In a third preferred embodiment of the present invention, an oil pit is provided such that the oil can drop from an area right outside the peripheral wall of the clutch rotating body in the radial direction.

Due to the above arrangement, the oil, which passes through the communicating holes and is directed to the outside of the peripheral wall of the clutch rotating body in the radial direction, passes through the oil pit in an early stage and drops. Therefore, despite the fact that the oil tends to be directed outward in the radial direction due to the centrifugal force, because it passes through the oil pit and drops in the early stage as described above, a radially inner portion of an oil supplied section that is disposed in an lower region of the clutch rotating body can be reliably lubricated with the oil. As a result, each component of the power transmission system can be lubricated evenly.

In a fourth preferred embodiment of the present invention, the communicating holes are arranged between a topmost clutch plate and a bottommost clutch plate of the plurality of clutch plates.

Due to the above arrangement, when the oil passes through the communicating holes and is directed to radially outside of the clutch rotating body in conjunction with the rotation of the clutch rotating body at startup of the engine, the oil is directly headed to each of the clutch plates to lubricate these clutch plates. Therefore, since these clutch plates are lubricated promptly once the clutch rotating body starts rotating, the deterioration of these clutch plates can be reliably prevented.

In a fifth preferred embodiment of the present invention, the marine propulsion unit includes a case supported by the hull; a propeller supported in the lower portion of the case; an upper planetary gear train and a lower planetary gear train housed in the case and disposed one above the other to receive the engine output, change the speed of the output, and transmit the output to the propeller; and an oil pan disposed below the upper and the lower planetary gear train and storing lubricating oil for the upper and the lower planetary gear train. A lubricator in the power transmission system of the marine propulsion unit is provided with an oil return passage that returns the oil having lubricated the upper planetary gear train to the oil pan while avoiding the lower planetary gear train.

Due to the above arrangement, the oil, which has lubricated the upper planetary gear train, is prevented from being supplied to the lower planetary gear train located under the upper planetary gear train. Accordingly, the oil that has lubricated the upper planetary gear train is prevented from being supplied to rotating bodies of the lower planetary gear train, such as a sun gear and a ring gear, and the oil is also prevented from unnecessary linkage rotation with these rotating bodies. Therefore, it is possible to prevent a power loss in the engine and a decline in fuel efficiency caused by this linkage rotation.

In a sixth preferred embodiment of the present invention, a transmission case is housed in the case and covers the lower planetary gear train. The oil return passage is defined in a side portion of the transmission case.

Here, since the transmission case is large in shape to cover the lower planetary gear train, a cross-sectional area of the oil return passage arranged in the transmission case can be enlarged. Due to the above arrangement, the oil that has lubricated the upper planetary gear train can be effectively collected in the oil pan through the oil return passage. In addition, as described above, the oil return passage is arranged in the lateral portion of the transmission case.

Therefore, since the oil return passage is arranged in the lateral portion of the transmission case in a plan sectional view of the transmission case, it is possible to minimize the forward expansion of a front outer surface of the transmission case. In addition, the above minimization also makes it possible to minimize the forward expansion of a front outer surface of the case housing the transmission case.

Accordingly, while a contact of the rear portion of the hull with the front outer surface of the case is avoided, the center of mass of the marine propulsion unit can be closer to the rear portion of the hull. As a result, it is possible to reduce the magnitude of support moment generated when the rear portion of the hull supports the marine propulsion unit; therefore, a load in intensity on the rear portion of the hull can be reduced.

In other words, due to the enlargement of the cross-sectional area of the oil return passage in the plan sectional view of the transmission case, even when it is attempted to effectively collect the oil in the oil pan through this oil return passage, it is possible to reduce the load in intensity on the rear portion of the hull that supports propulsion of the boat.

In a seventh preferred embodiment of the present invention, the upper planetary gear train and the lower planetary gear train are disposed on a same axis that extends in the vertical direction. A power transmission shaft is provided on the axis of the upper planetary gear train, and is arranged with an oil supply passage that extends in an axial direction. The lubricating oil for the lower planetary train is supplied through the oil supply passage.

Due to the above arrangement, oil supply to the lower planetary gear train through the oil supply passage can be carried out without intervention of the upper planetary gear train. In addition, the oil is supplied to a rotational center of the lower planetary gear train. Therefore, the oil is supplied to the lower planetary gear train in an appropriate amount, and the oil supplied to the rotational center of the lower planetary gear train is then supplied to the outside in the radial direction due to the centrifugal force. As a result, the lubrication of the lower planetary gear train can be carried out evenly and nicely.

In an eighth preferred embodiment of the present invention, right and left front bolts that extend in the vertical direction to fasten the front portion of the transmission case to the case are provided. Right and left rear bolts that extend in the vertical direction are also provided to fasten the rear portion of the transmission case to the case. A width dimension between the right front bolt and the left front bolt is larger than that between the right rear bolt and the left rear bolt in a width direction of the hull.

Due to the above arrangement, since the right and the left front bolt can be respectively positioned in the right side portion and the left side portion of the transmission case, it is possible to minimize the forward expansion of the front outer surface of the transmission case for disposition of each of the front bolts. In addition, the above minimization also makes it possible to minimize the forward expansion of the front outer surface of the case housing the transmission unit.

Therefore, for the same reason as the effect of the sixth preferred embodiment of the present invention, it is possible to reduce the load in intensity on the rear portion of the hull.

In a ninth preferred embodiment of the present invention, a cooling water passage that is arranged in the side portion of the transmission case to run cooling water is disposed outside the oil return passage.

Due to the above arrangement, the oil in the oil return passage can be cooled directly and effectively with the cooling water flowing through the cooling water passage. Therefore, the oil degradation can be reliably prevented.

In addition, as described above, the cooling water passage arranged in the side portion of the transmission case is disposed outside the oil return passage.

Due to the above arrangement, since the cooling water passage is located closer to the outer surface of the transmission case than the oil return passage, it is possible to extend the cooling water passage. Therefore, with the extension of the cooling water passage, it is possible to increase a quantity of the cooling water that flows through the cooling water passage, and thus, the oil in the oil return passage can be sufficiently cooled.

In a tenth preferred embodiment of the present invention, an area of the cooling water passage is larger than that of the oil return passage in the plan sectional view of the transmission case.

Therefore, it is possible to increase the quantity of the cooling water that flows through the cooling water passage, and thus, the oil flowing through the oil return passage can be sufficiently cooled with the cooling water.

In an eleventh preferred embodiment of the present invention, the cooling water passage and the oil return passage are arranged in arc shapes that follow a lateral wall of the transmission case. The transmission case and the lower planetary gear train share a common axis that extends in the vertical direction. The arc of the cooling water passage around the axis is longer than that of the cooling water passage around the axis in the plan sectional view of the transmission case.

Due to the above arrangement, the cross-sectional area of the cooling water passage can be further enlarged. Therefore, it is possible to increase the quantity of the cooling water that flows through the cooling water passage, and thus, the oil in the oil return passage can be further sufficiently cooled.

In a twelfth preferred embodiment of the present invention, the marine propulsion unit includes a case supported by the hull; a propeller supported in the lower portion of the case; a transmission unit housed in the case to receive the engine output, change the speed of the output, and transmit the output to the propeller; a cylindrically-shaped transmission case with its outer shell defined by the transmission unit and with an axis extending in the vertical direction; and the transmission housed in the transmission case to change the speed of the output. The power transmission system of the marine propulsion system includes an oil pan arranged in the bottom portion of the transmission case, an inlet port disposed in the front portion of the oil pan, an oil pump provided in the upper portion of the transmission case, an oil inlet passage that communicates the oil inlet port with an inlet section of the oil pump, and the oil supply passage that communicates a discharge section of the oil pump with the oil supplied section.

Due to the above arrangement, once the oil pump is activated, the oil in the oil pan is suctioned into the oil pump through the inlet port and the oil supply passage in sequence. Then, the oil discharged from this oil pump is supplied to the supplied section through the oil supply passage to lubricate the supplied section.

As described above, the inlet port is arranged in the front portion of the oil pan. The oil in the oil pan is suctioned into the oil pump through the inlet port and the oil inlet passage in sequence.

Due to the above arrangement, when the case of the marine propulsion unit is tilted along with the propeller, the oil tends to be concentrated in the front portion of the oil pan, which is also tilted jointly. However, the oil is smoothly suctioned into the oil pump through the inlet port and the oil inlet passage in sequence, and then is supplied to the supplied section of the transmission unit for lubrication. Therefore, even in the case where the case is tilted, the lubrication in the transmission unit is effectively carried out.

In a thirteenth preferred embodiment of the present invention, a bottom portion of the transmission case is separately provided from an upper portion thereof. The bottom portion is detachably secured to the upper portion.

Due to the above arrangement, servicing, such as maintenance of the oil pan, can be easily conducted without the intervention of the upper portion by detaching the bottom portion from the upper portion of the transmission case.

In a fourteenth preferred embodiment of the present invention, while the bottom portion of the transmission case is detached from the upper portion thereof, the inlet port can be detached from an lower surface of the upper portion of the transmission case.

Due to the above arrangement, if the bottom portion is detached from the upper portion of the transmission case, the inlet port can easily be attached to the lower surface of the upper portion. Therefore, an assembling property of the transmission unit is improved.

In a fifteenth preferred embodiment of the present invention, at least one of the oil inlet passage and the oil supply passage is arranged in either a right or a left side portion of the transmission case. The oil return passage arranged to return the oil having been supplied to the supplied section to the oil pan is arranged in the other side portion of the transmission case.

Here, the oil inlet passage and the oil supply passage are the passages through which the oil is forcefully flowed by the oil pump. Thus, even if the cross-sectional area of each of these passages is reduced to some extent, a desired flow rate of the oil can be obtained by increasing the flow speed of the oil. On the other hand, the oil naturally flows down by its own weight in the oil return passage, the cross-sectional area of the oil return passage has to be relatively large for the smooth downward flow of the oil.

For the above reason, the oil return passage and at least one of the oil inlet passage and the oil supply passage are separately disposed in the right and the left side portion of the transmission case. According to this arrangement, the cross-sectional areas of the side portions of the transmission case can be arranged in a fine balance. Then, as described above, each of the passages is separately disposed in the right and the left side portion of the transmission case. Consequently, it is possible to minimize the forward expansion of the front outer surface of the transmission case of the transmission unit in the plan sectional view of the transmission unit. In addition, the above minimization also makes it possible to minimize the forward expansion of the front outer surface of the case housing the transmission unit.

Accordingly, while the contact of the rear portion of the hull with the front outer surface of the case is avoided, the center of mass of the marine propulsion unit can be closer to the rear portion of the hull. As a result, it is possible to reduce the magnitude of the support moment generated when the rear portion of the hull supports the marine propulsion unit; therefore, the load in intensity on the rear portion of the hull can be reduced.

In other words, even in the case where the oil effectively flows through each of the passages and sufficiently lubricates the transmission unit due to the maximum enlargement of the cross-sectional area of each of the passages for the oil in the plan sectional view of the transmission unit, it is possible to reduce the load in intensity on the rear portion of the hull that supports the propulsion of the boat as described above.

In a sixteenth preferred embodiment of the present invention, in a plan sectional view of the transmission unit, the cross-section of the oil return passage is in a curved shape that follows a cross-sectional shape of the other side portion of the transmission case.

Due to the above arrangement, it is possible to enlarge the cross-sectional area of the oil return passage while avoiding a decline in strength of the other side portion of the transmission case, which can be caused by the fabrication of the oil return passage. Therefore, when the oil naturally flows down by its own weight in the oil return passage, the downward flow thereof can be conducted smoothly, and it is preferable for the lubrication thereafter.

In a seventeenth preferred embodiment of the present invention, the cooling water passage arranged to flow cooling water is arranged in the bottom portion of the transmission case.

Due to the above arrangement, the oil that is collected in the oil pan arranged in the bottom portion of the transmission case is directly and effectively cooled with the cooling water that flows through the cooling water passage. Therefore, the degradation of the oil can be reliably prevented.

Other features, elements, steps, characteristics and advantages of the present invention will become more apparent from the following detailed description of preferred embodiments of the present invention with reference to the attached drawings.

BRIEF DESCRIPTION OF THE DRAWINGS

FIG. 17 is a view illustrating operations of the transmission unit.

DETAILED DESCRIPTION OF THE PREFERRED EMBODIMENTS

Figure 1:
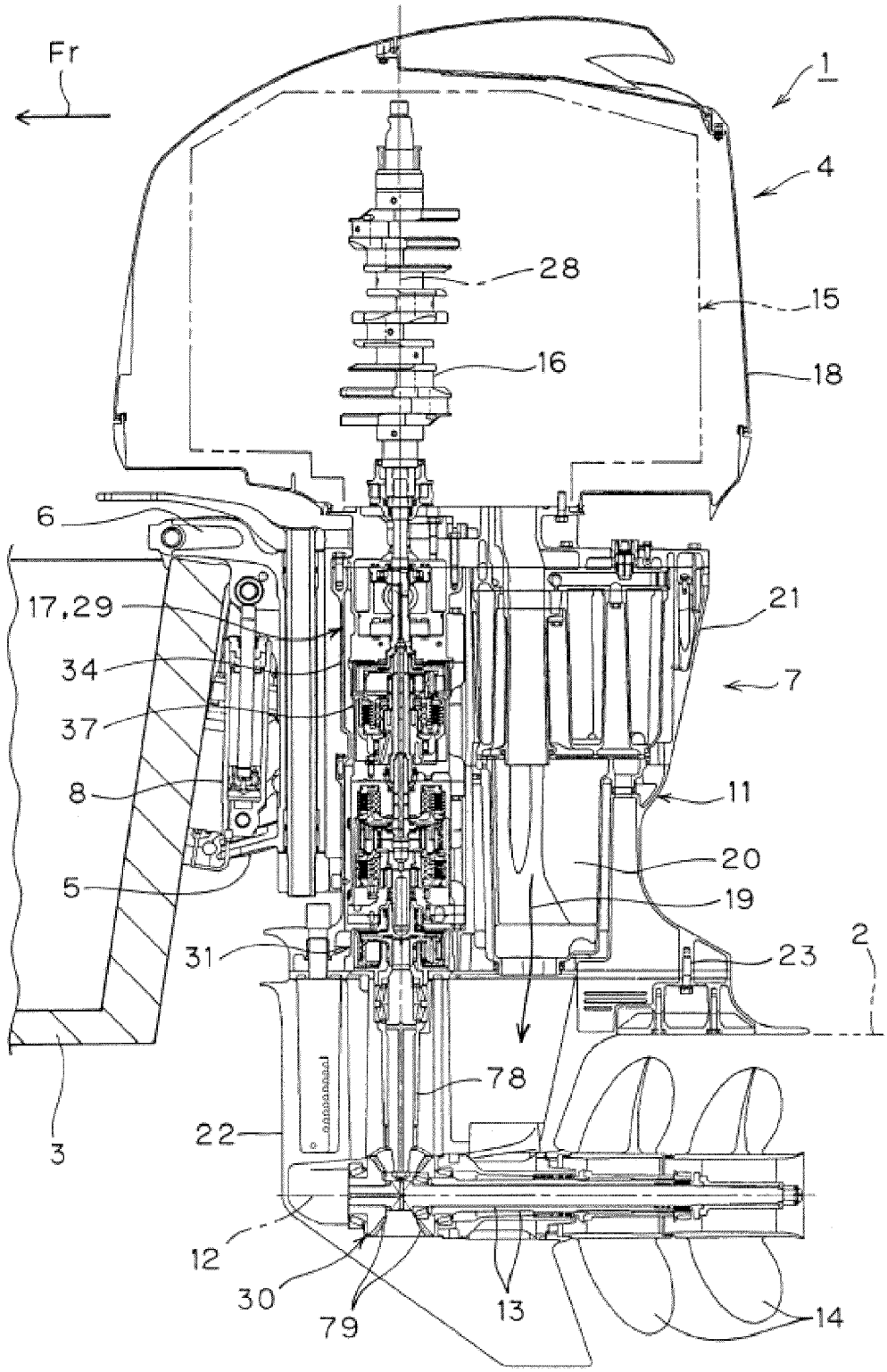
FIG. 1 is a sectional side view of a marine propulsion unit in which a transmission unit is shown in a sectional view.
Figure 2:
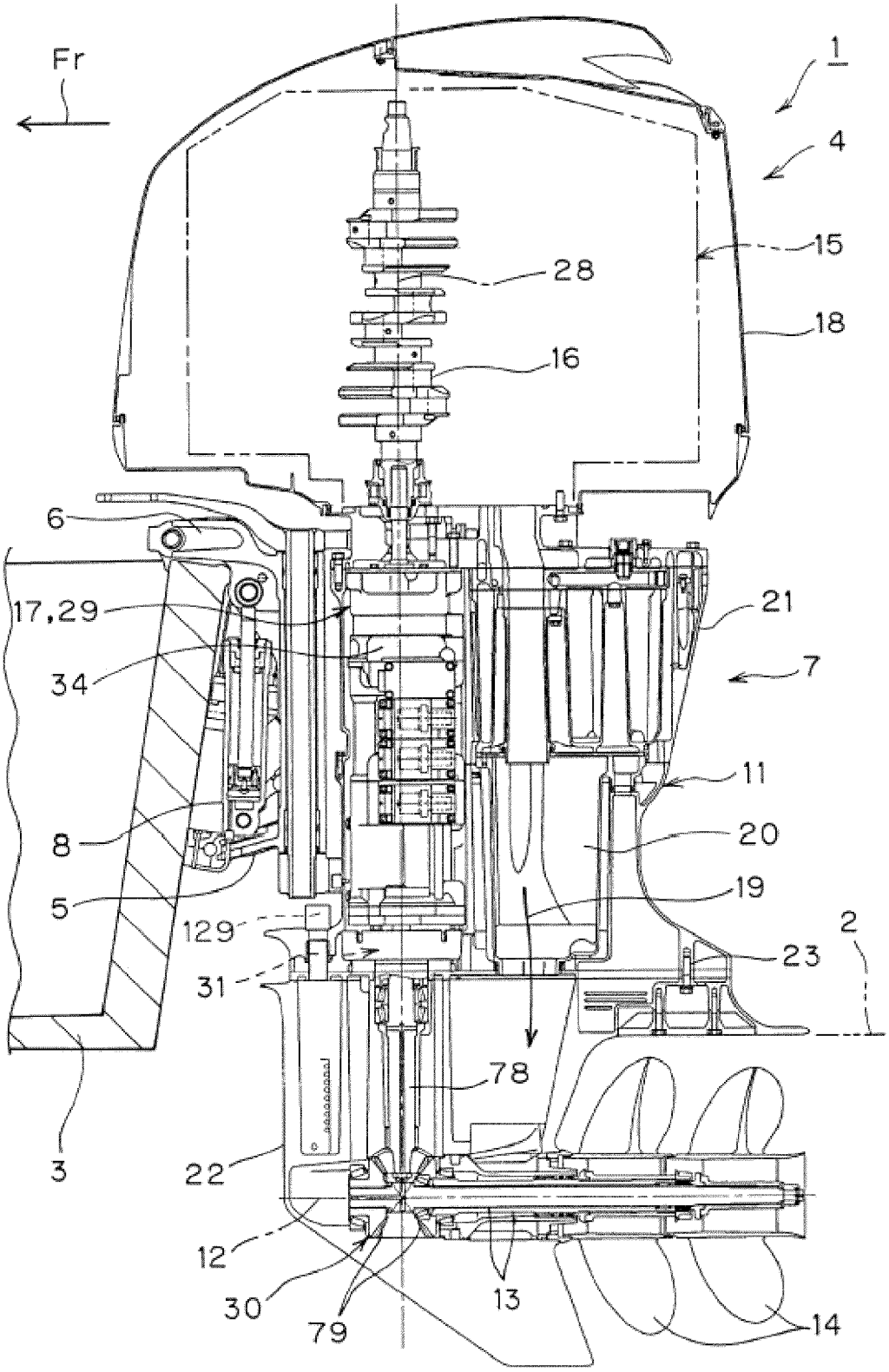
FIG. 2 is a sectional side view of the marine propulsion unit in which the transmission unit is shown in contour.

In FIGS. 1 and 2, reference numeral 1 denotes a boat, and the arrow Fr indicates a forward direction in which the boat 1 is propelled. The term "right and left" described below designates a width direction of the boat 1 with respect to the forward direction.

The boat 1 includes a hull 3 arranged to float on water 2 and a boat propulsion unit 4 that is detachably supported at the rear of the hull 3 to propel the boat 1. The surface of the water 2 shown by a double-dashed line in FIGS. 1 and 2 indicates a water surface when the boat 1 is traveling forward. The surface of the water 2 rises slightly with respect to the boat 1 when the boat 1 stops.

The marine propulsion unit 4 includes a clamping bracket 5 detachably supported on the rear of the hull 3, a swivel bracket 6 supported by the clamping bracket 5 and arranged to rotate vertically, and a propulsion unit 7 supported by the swivel bracket 6. A hydraulic cylinder 8 is suspended between the clamping bracket 5 and the swivel bracket 6 to rotatably drive the propulsion unit 7 for trimming or tilting with the swivel bracket 6.

The propulsion unit 7 includes a case 11 that is supported by the swivel bracket 6, extends vertically, and has a lower end side submerged under the water 2. In the lower end portion of the case 11, a propeller shaft 13 is arranged to rotate about an axis 12 that extends in a fore-and-aft direction. A propeller 14 is provided at the tip of the propeller shaft 13. An engine 15 is mounted on top of the case 11, and a power transmission system housed in the case 11 transmits the engine power to the propeller. The power transmission system can receive an output from a crankshaft 16 of the engine 15, change the speed of the output, and switch the rotation of the output to either forward rotation A or reverse rotation B. The engine 15 is preferably covered with an openable and closable cowling 18. The case 11 is placed right behind the hull 3.

The propeller shafts 13 and the propellers 14 are preferably provided in pairs on the axis 12. The helical directions of the paired propellers 14, 14 are opposite to each other. When the output transmitted from the power transmission system 17 to each of the propellers 14 is in the forward rotation A, the propellers 14, 14 rotate in the opposite directions to propel the boat 1 forwardly. On the other hand, when the output from the power transmission system 17 is in the reverse rotation B, each of the propellers 14, 14 rotates in a reverse direction from the above direction to propel the boat 1 backwards. In an open space in a portion (rear portion) of the case 11, an exhaust passage 20 is preferably arranged to emit exhaust gas 19 discharged from the engine 15 by guiding the exhaust gas 19 to an area under the surface of the water 2.

In FIGS. 1 to 13, the case 11 is defined by an upper case 21 that defines the upper side of the case 11 and a lower case 22 that is arranged separately from the upper case 21 and defines the lower side of the case 11. The major portion of the lower case 22 is usually located in the water 2 while the boat 1 is being propelled. The upper case 21 and the lower case 22 are preferably detachably secured by a fastener 23, for example. In addition, the lower case 22 is defined by a top plate 24 defining a top surface thereof and a lower case body 25. The lower case body 25 is arranged separately from the top plate 24 to define a lower side below the top plate 24 and is detachably secured to the top plate 24 by a fastener, which is not shown.

The power transmission system 17 is preferably includes a transmission unit 29, an interlocking device 30, and a speed reduction device 31. The transmission unit 29 is housed in the other (front) open space in the case 11 and has an axis 28 extending in a vertical direction. The transmission unit 29 receives the output from the engine 15, changes the speed of the output, and transmits the output. The interlocking device 30 receives the output from the transmission unit 29 and changes the direction of the output to direct it to the propellers 14. The speed reduction device 31 is interposed between the transmission unit 29 and the interlocking device 30, receives the output from the transmission unit 29, reduces the speed of the output with a large speed reduction ratio, and transmits it to the interlocking device 30.

The transmission unit 29 is defined by a transmission case 34 and a transmission 37. The transmission case 34 is preferably a cylindrically-shaped case that defines an outer shell of the transmission unit 29 and is disposed on the axis 28. The front portion of the transmission case 34 is preferably fastened to the case 11 with right and left front bolts 35, which extend vertically in parallel or substantially in parallel with the axis 28. The rear portion of the transmission case 34 is fastened to the case 11 by right and left rear bolts 36, which extend vertically in parallel or substantially in parallel with the axis 28. The transmission 37 is housed in the transmission case 34, receives the output from the engine 15, changes the speed of the output, and transmits it to the propellers 14 through the speed reduction device 31 and the interlocking device 30 in sequence.

The transmission case 34 includes a first, second, and third case 40, 41, and 42, respectively, that are separately arranged and sequentially arranged from the upper end to the lower end of the transmission case 34. The transmission case 34 also preferably includes a substantially flat case bottom 43 that closes an opening at the lower end of the third case 42. In addition, the case bottom 43 includes upper and lower bottom plates 44, 45 that are separately arranged and stacked on each other. The members 40 to 45 defining the transmission case 34 are integrally secured to each other by the front bolts 35 and the rear bolts 36.

The transmission device 37 is provided with a first, second, and third power transmission shaft 48, 49, and 50, respectively, that are sequentially arranged from top to bottom on the axis 28. These shafts 48 to 50 are supported by the transmission case 34 so as to individually rotate about the axis 28. The second power transmission shaft 49 includes a plurality of (e.g., two) rotating shafts that are located on the axis 28 and are arranged separately. The rotating shafts are preferably spline-fitted to each other and rotate integrally.

The transmission 37 preferably includes an upper planetary gear train 51 and a lower planetary gear train 52. Of these gear trains, the upper planetary gear train 51 includes a sun gear 54 that is rotatable about the axis 28, a ring gear 55 that rotates together with the first power transmission shaft 48, and a planetary gear 57 that is pivotally supported by a carrier 56 to rotate together with the second power transmission shaft 49 and meshes with the sun gear 54 and the ring gear 55. In contrast, the lower planetary gear train 52 includes a sun gear 59 rotating together with the third power transmission shaft 50, a ring gear 60 that is rotatable about the axis 28, a planetary gear 62 that is supported by a carrier 61 rotating together with the second power transmission shaft 49 and meshes with the sun gear 59, and another planetary gear 63 that is pivotally supported by the carrier 61 and meshes with the ring gear 60 and the planetary gear 62.

In addition, the transmission device 37 includes a first, second, and third clutch 66, 67, and 68, respectively, that are preferably wet-type multiplate clutches. The clutches 66 to 68 are mounted about the axis 28. Each of the clutches 66 to 68 is usually in a disengaged state due to the action of a spring; however, they are caused to be in an engaged state by a pressing action of a first, second, and third hydraulic piston 70, 71, and 72, respectively, on clutch plates 73. A plurality of the clutch plates 73 are provided in an axial direction and are preferably annular-shaped.

When the first clutch 66 is engaged, the sun gear 54, the ring gear 55, and the carrier 56 of the upper planetary gear train 51 rotate integrally about the axis 28. Here, a one-way clutch 75 is provided between the sun gear 54 and the transmission case 34 to permit the forward rotation A of the sun gear 54 of the upper planetary gear train 51 and inhibit the reverse rotation B thereof. Also, when the second clutch 67 is engaged, the ring gear 60 of the lower planetary train 52 is secured to the transmission case 34. In addition, when the third clutch 68 is engaged, the carrier 61 of the lower planetary train 52 and the third power transmission shaft 50 rotate integrally about the axis 28.

Figure 6:
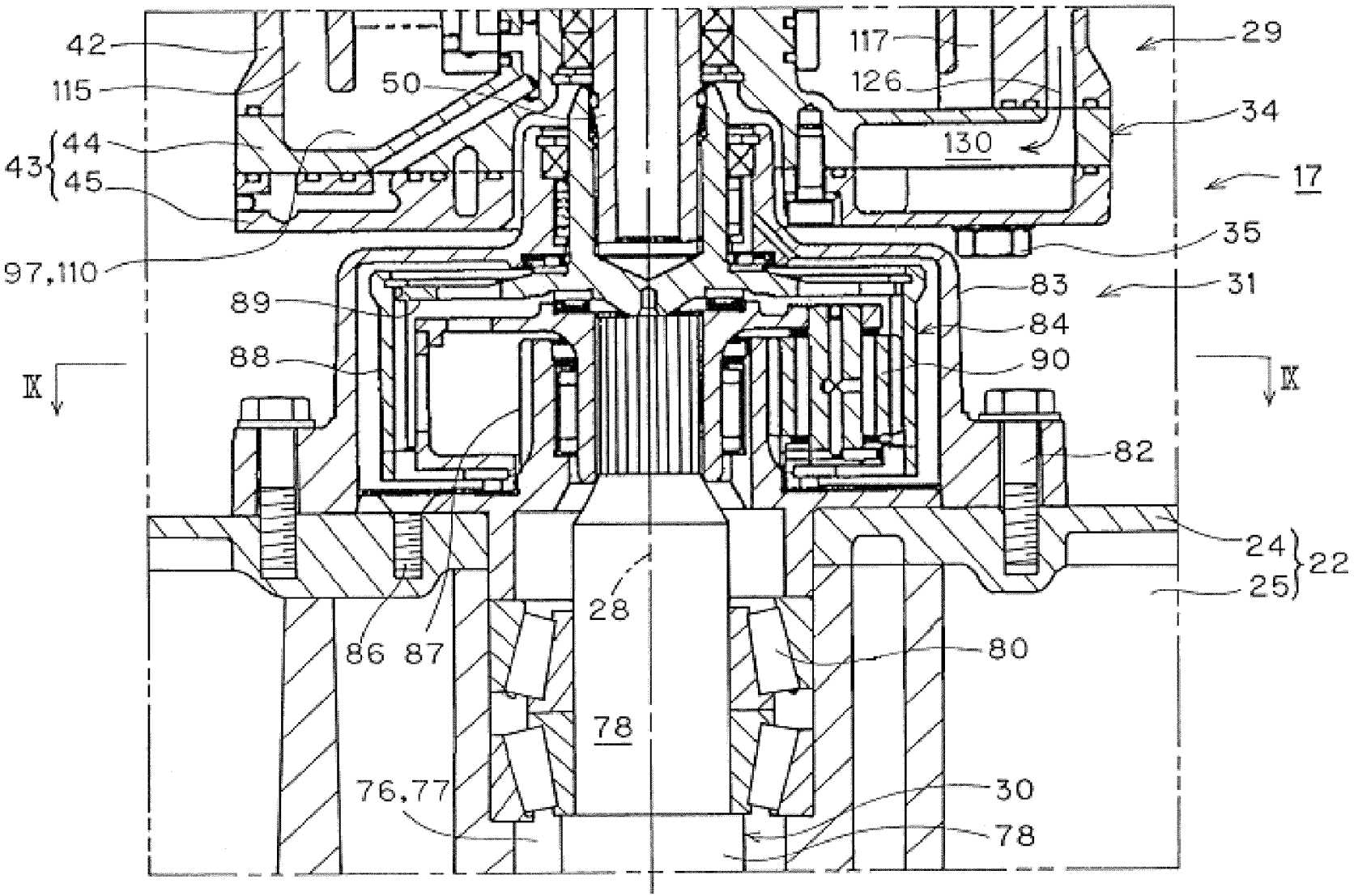
FIG. 6 is an enlarged sectional view showing another portion of FIG. 4.

In FIG. 6, a bottom accommodating chamber 77 that opens upward on the axis 28 and accommodates lubricating oil 76 is arranged in the front portion of the lower case 22. The interlocking device 30 is defined by a fourth power transmission shaft 78, a paired set of bevel gears 79, 79, and a pair of upper and lower bearings 80. The fourth power transmission shaft 78 is located on the axis 28, accommodated in the accommodating chamber 77, and supported by the lower case 22 so as to rotate about the axis 28. The paired set of bevel gears 79, 79 is accommodated in the accommodating chamber 77 and interlocks the front end portions of the propeller shaft 13, 13 with the lower end portion of the fourth power transmission shaft 78. The pair of upper and lower bearings 80 supports the fourth power transmission shaft 78 on the inner surface of the accommodating chamber 77.

The upper bearing 80 is preferably a roller bearing. Almost all the portions of the fourth power transmission shaft 78, each of the bevel gears 79, and each of the bearings 80 are soaked in the oil 76 in the accommodating chamber 77. An opening at the upper end of the accommodating chamber 77 is communicated with the inside of the speed reduction device 31 through the upper bearing 80.

When the interlocking device 30 is activated so that power is transmitted from the fourth power transmission shaft 78 to each of the propeller shafts 13 through each of the bevel gears 79 where the direction of the power is altered, the propeller shafts 13 are configured to be decelerated and rotated together with the propellers 14 in opposite directions. In addition, the bearings 80 permit the oil 76 to flow into the speed reduction device 31 when the interlocking device 30 is activated, causing the oil 76 to be pushed upward within the accommodating chamber 77.

Figure 4:
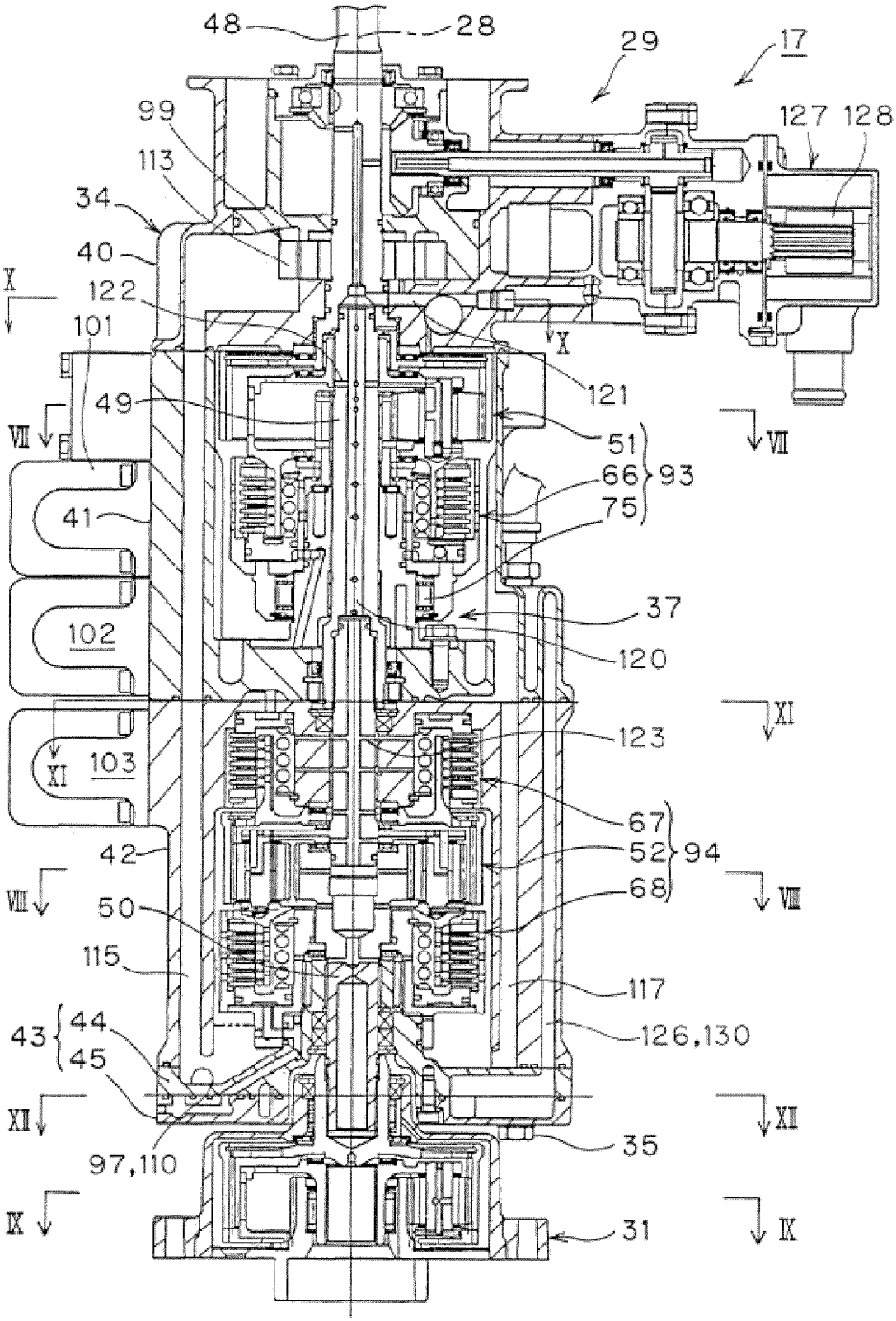
FIG. 4 is an enlarged sectional rear view of the transmission unit.
Figure 9:
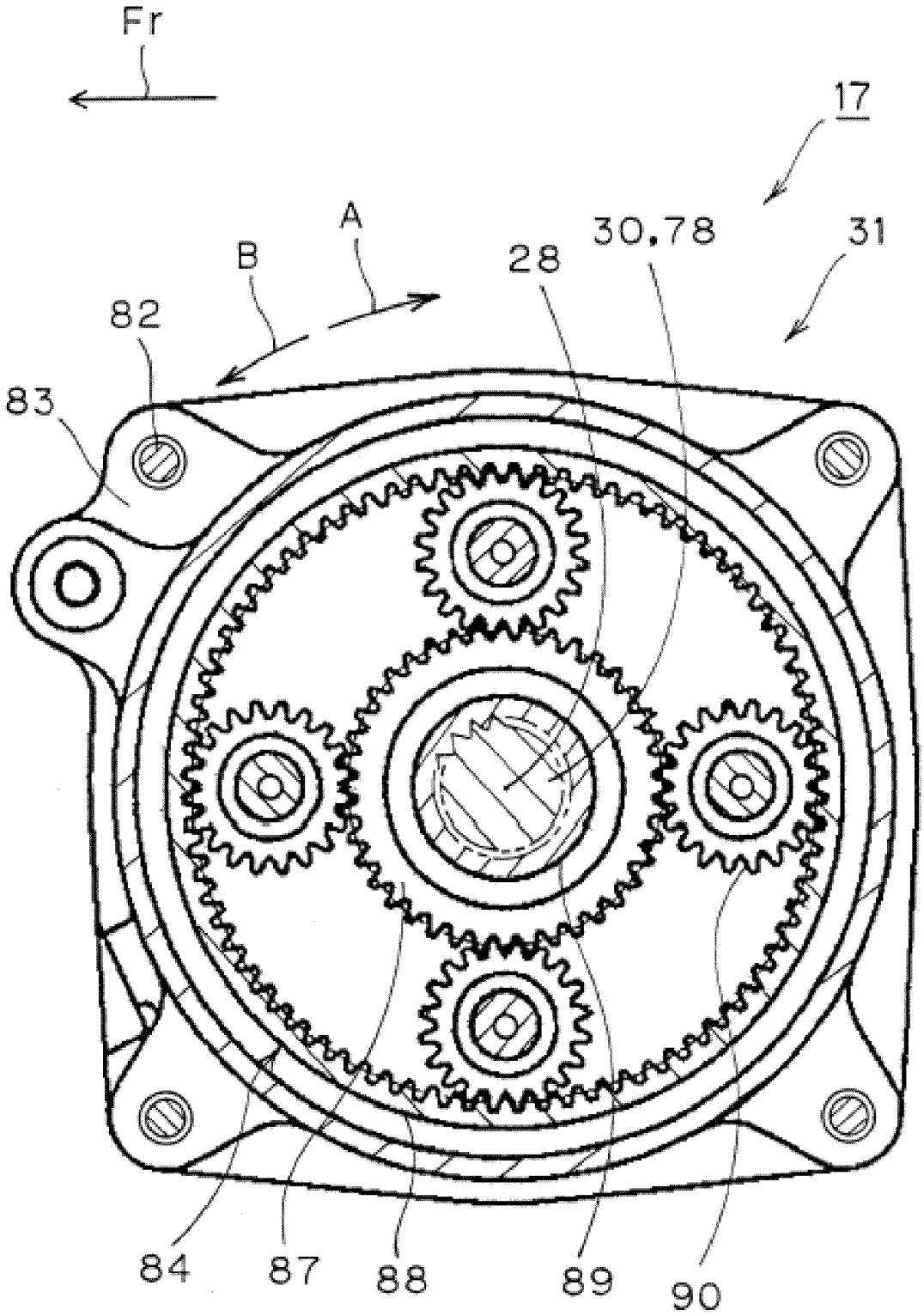
FIG. 9 is a sectional view taken along the line IX-IX of FIG. 4.
Figure 10:
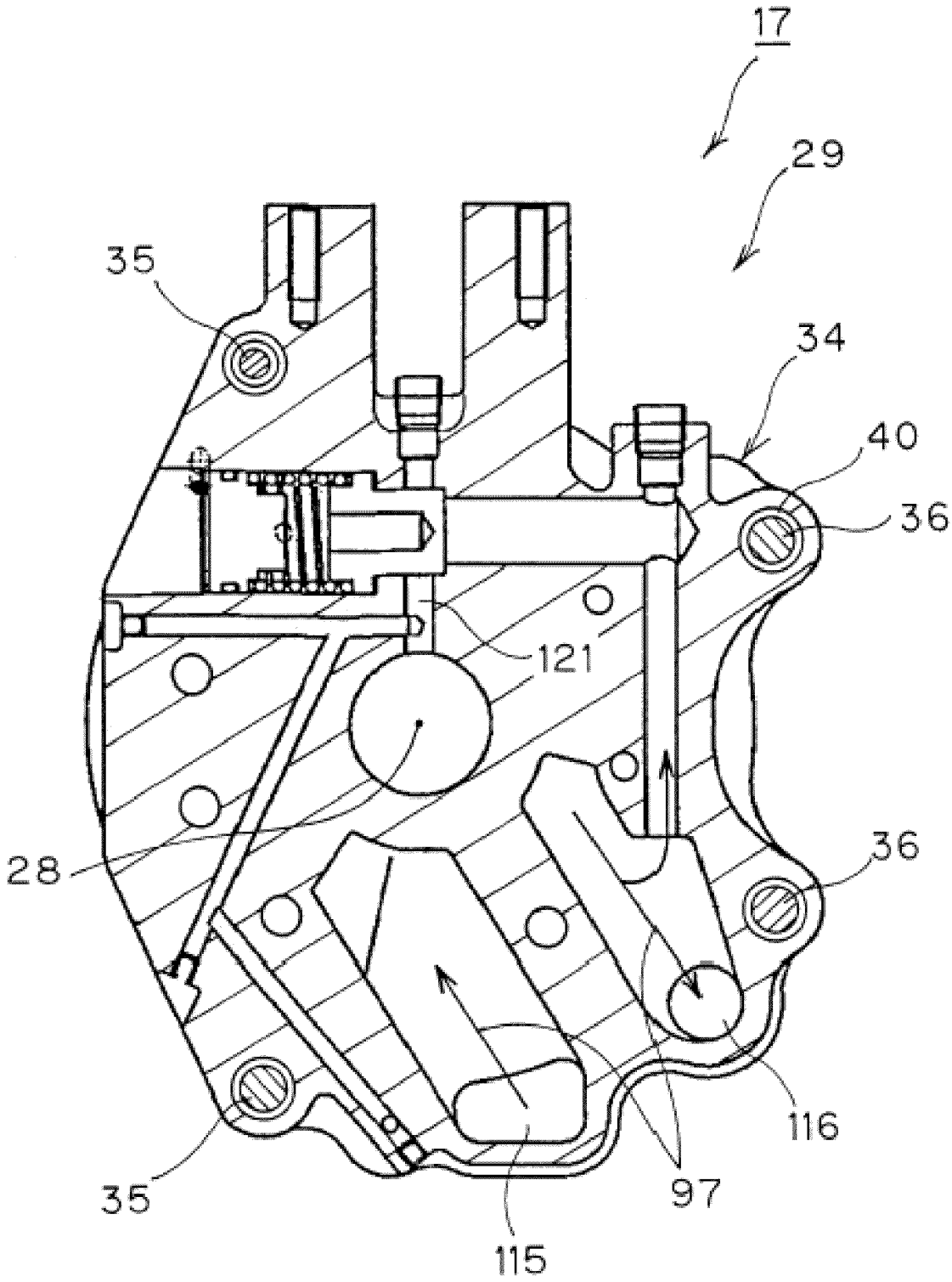
FIG. 10 is a sectional view taken along the line X-X of FIG. 4.
Figure 11:
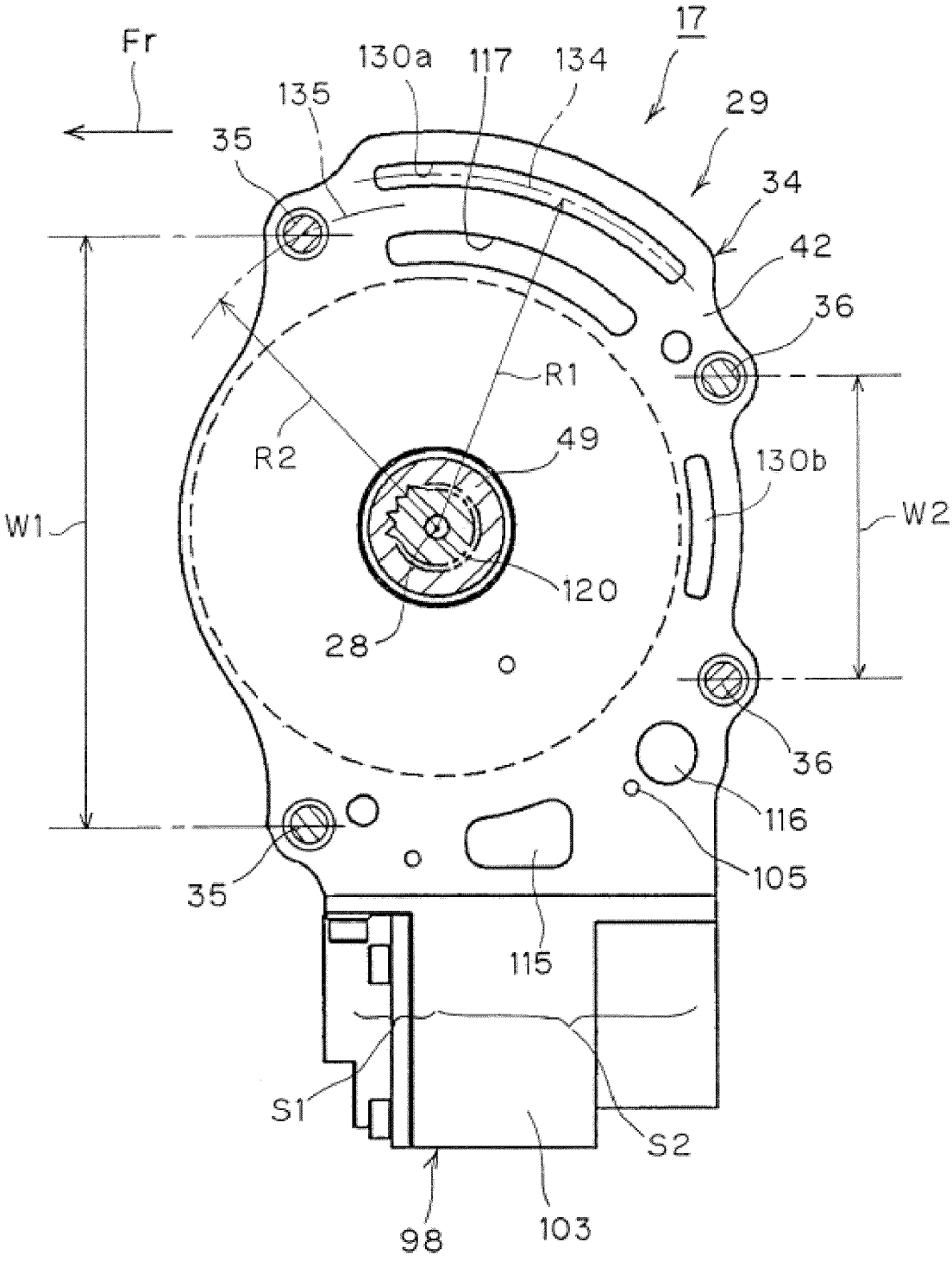
FIG. 11 is a sectional view taken along the line XI-XI of FIG. 4.
Figure 12:
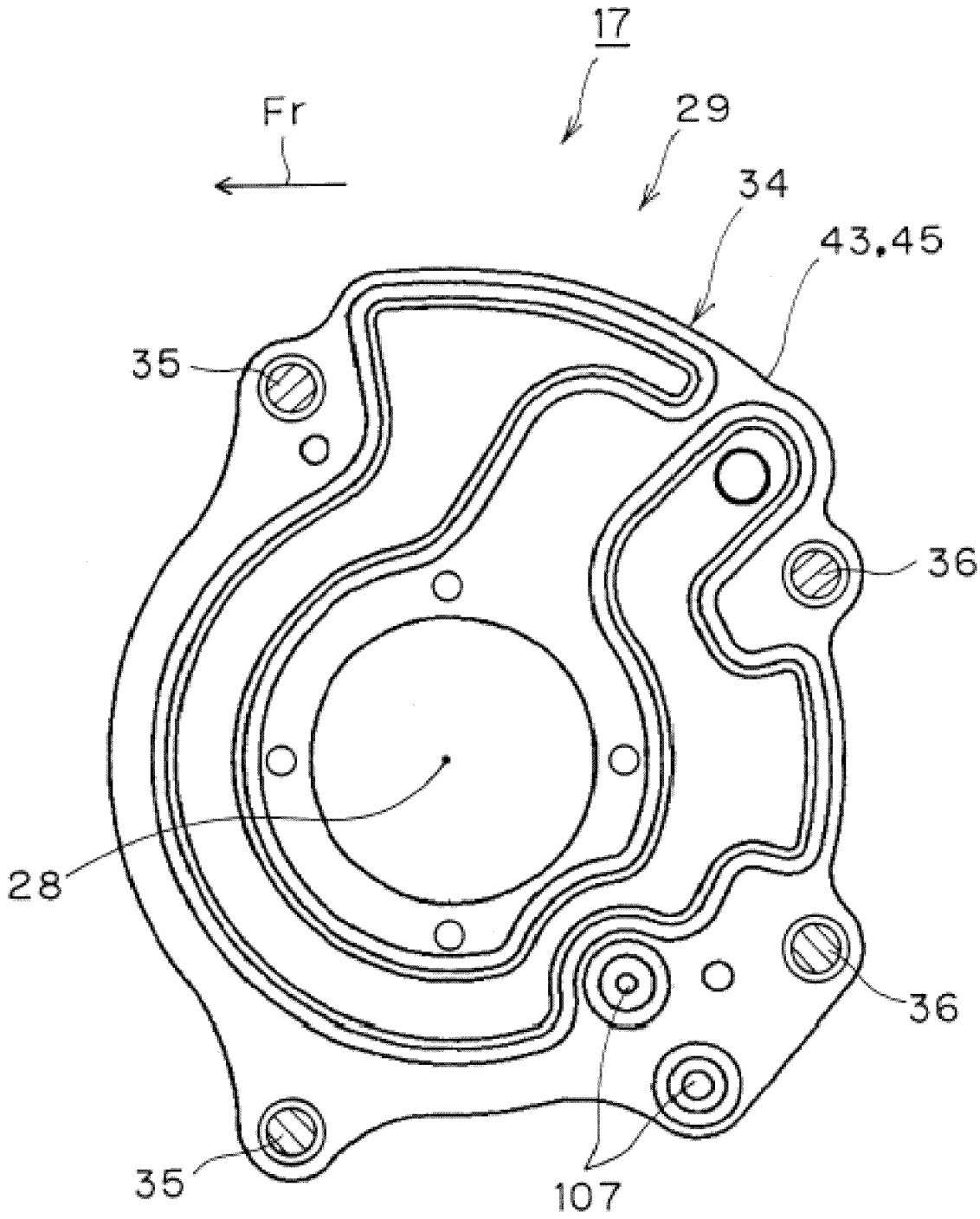
FIG. 12 is a sectional view taken along the line XII-XII of FIG. 4.

In FIGS. 4, 6, 9, the speed change device 31 is disposed within a proximal portion between the opposed surfaces of the upper case 21 and the lower case 22 of the case 11 in the vertical direction. More specifically, the speed change device 31 is disposed within the lower end portion of the upper case 21 and supported on the upper surface of the lower case 22. However, the speed change device 31 may be provided in the inner portion of the case 11 that is at the same height as the opposed surfaces of the upper case 21 and the lower case 22, or may be disposed within the upper end portion of the lower case 22.

The speed change device 31 includes a reduction gear case 83 and a planetary gear train 84. The reduction gear case 83 defines an outer shell of the speed change device 31, and is detachably secured to the top plate 24 of the lower case 22 by fasteners 82. The planetary gear train 84 is housed in the reduction gear case 83, receives the output from the third power transmission shaft 50 of the transmission device 37, and reduces the speed of the output with a large reduction ratio before transmitting the output to the fourth power transmission shaft 78 of the interlocking device 30.

The planetary gear train 84 includes a sun gear 87 secured to the top plate 24 of the lower case 22 by a fastener 86 and integrally provided with the lower case 22, a ring gear 88 supported by the reduction gear case 83 for rotation about the axis 28 and preferably detachably spline-fitted to the lower end of the third power transmission shaft 50 of the transmission device 37, and a planetary gear 90 pivotally supported by a carrier 89 that rotates together with the fourth power transmission shaft 78 of the interlocking device 30 and meshing with the sun gear 87 and the ring gear 88.

When the transmission unit 29 and the speed change device 31 are assembled, the lower end of the third power transmission shaft 50 in the transmission unit 29 is preferably spline-fitted to the ring gear 88 in the speed change device 31 in a state where the speed change device 31 is fixed to the lower case 22. Then, the above assembly can be provided.

The upper planetary gear train 51, the first clutch 66, and the one-way clutch 75 in the transmission device 37 of the transmission unit 29 define a speed change section 93 to change the speed of the output from the power transmission system 17 either to low speed or high speed. The lower planetary gear train 52 and the second and the third clutches 67, 68 in the transmission device 37 define a rotational direction switching section 94 to switch the rotational direction of the output of the power transmission system 17 either to the forward rotation A or to the reverse rotation B.

In FIGS. 2 to 8, an oil supply device 99 is provided to supply oil 97 to a supplied section 98 to which the oil 97 should be supplied for the operation and lubrication of the first to the third pistons 70 to 72 of the first to the third clutches 66 to 68 of the marine propulsion unit 4.

The oil supply device 99 is provided with a first, second, and a third hydraulically-controlled valve 101, 102, and 103, respectively, that are solenoid operated valves and respectively correspond to the first to the third clutches 66 to 68. These valves 101 to 103 are attached to an outer surface of a side (left side) portion of the transmission case 34. A first, second, and third pressured oil passage 105, 106, and 107, respectively, are arranged in the transmission case 34 such that they respectively extend from the first to the third hydraulically-controlled valves 101 to 103 to each hydraulic chamber that corresponds to the first to the third pistons 70 to 72. The pressurized oil 97 is supplied to each of the hydraulic chambers through each of the hydraulically-controlled valves 101 to 103. Consequently, the pressing operation of the first to the third pistons 70 to 72 against the clutch plates 73 is made possible.

The oil supply device 99 preferably includes an oil pan 110 arranged in a bottom portion of the transmission case 34; a pipe-shaped inlet port 111 with an entry section disposed in a front portion of the oil pan 110 and with an exit section extending obliquely upward to a side (left side) portion of the transmission case 34; a wire-woven oil filter 112 attached to the entry section of the inlet port 111; and an oil pump 113 that is provided in the first case 40 of the transmission case 34 and is driven by the engine 15 through the first transmission shaft 48. In a state where the case bottom 43 is detached from the third case 42 of the transmission case 34, a lower end opening of the third case 42 opens downward. Then, the inlet port 111 is detachably secured to a lower surface of the third case 42 with a fastener through the lower end opening.

The oil supply device 99 also preferably includes an oil inlet passage 115 arranged in the transmission case 34 so that the exit section of the inlet port 111 is communicated with an inlet section of the oil pump 113; a first oil supply passage 116 arranged in the transmission case 34 so that a discharge section of the oil pump 113 is communicated with the first to the third hydraulically-controlled valves 101 to 103, which correspond to the supplied section 98; an oil return passage 117 arranged to return the oil 97 to the oil pan 110 after the oil 97 is supplied to the hydraulic chambers corresponding to the first to the third pistons 70 to 72.

Figure 7:
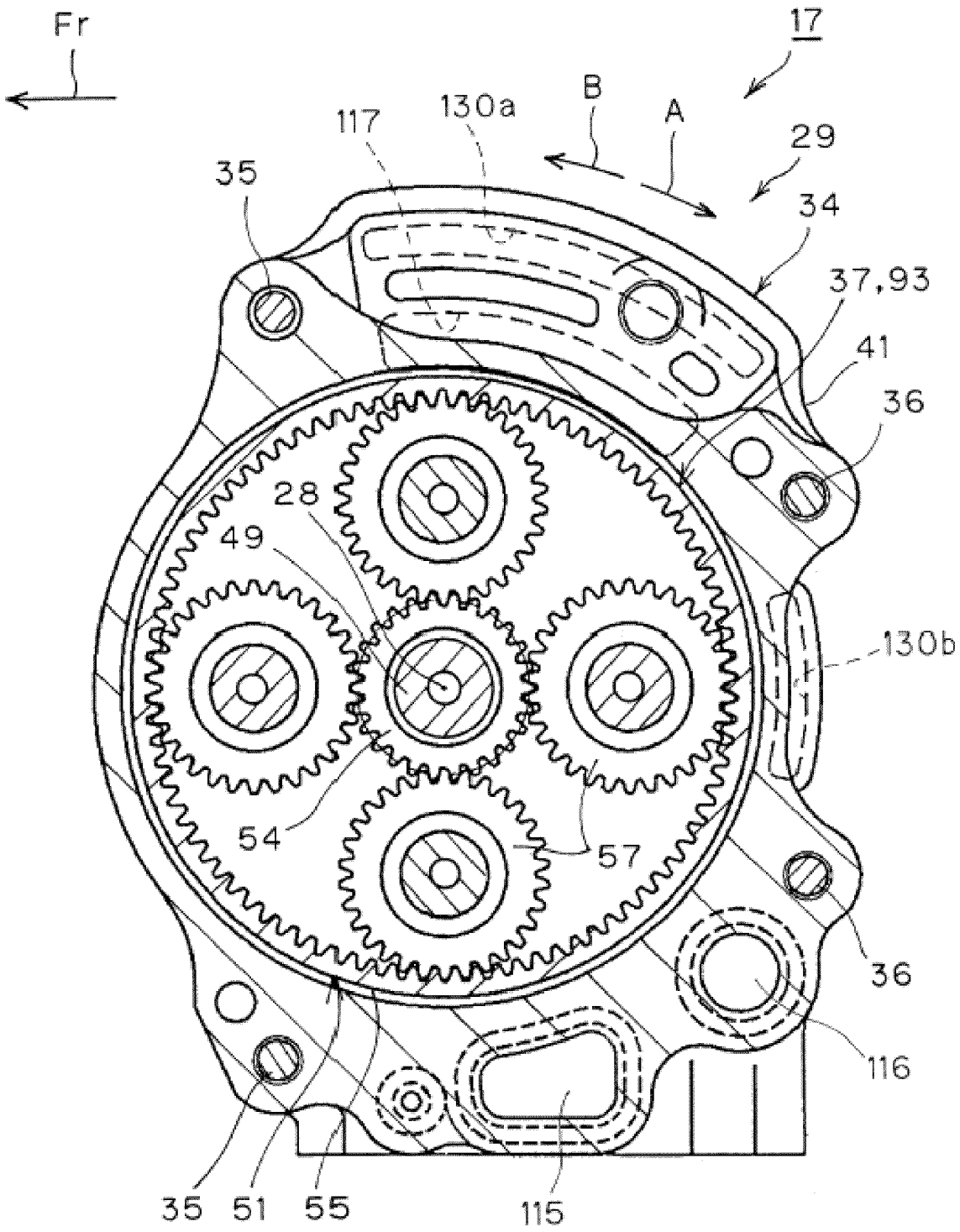
FIG. 7 is a sectional view taken along the line VII-VII of FIG. 4.
Figure 8:
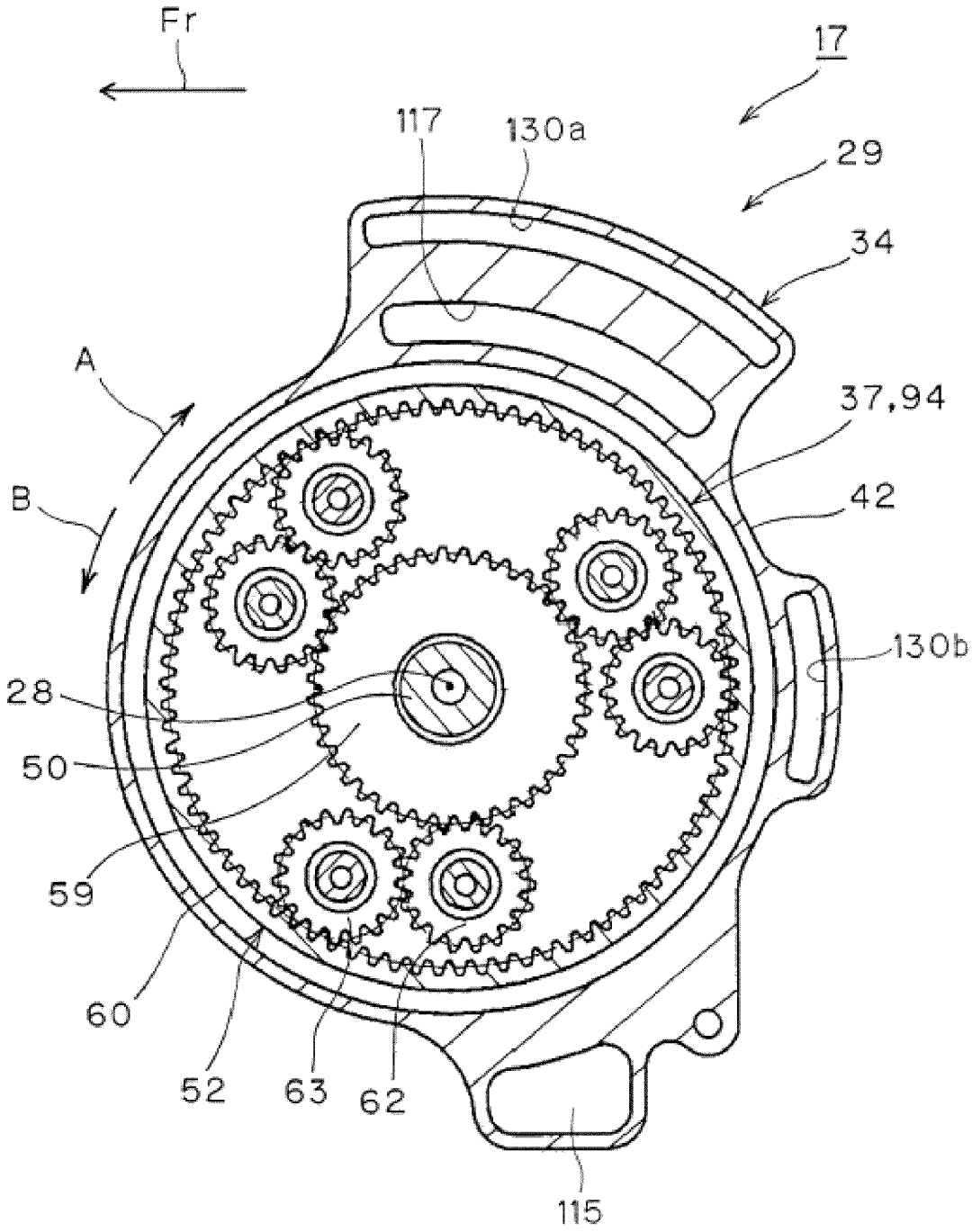
FIG. 8 is a sectional view taken along the line VIII-VIII of FIG. 4.

As shown in FIGS. 7 and 8, the oil inlet passage 115 and the first oil supply passage 116 are arranged in a side (left side) portion of the right and the left side portions of the transmission case 34. Meanwhile, the oil return passage 117 is arranged in the other side (right side) portion of the transmission case 34. In this case, the lower portion of the transmission case 34 entirely covers the lower planetary gear train 52 from the outside in its radial direction, and the oil return passage 117 is arranged in the other side (right side) portion in the lower portion of the transmission case 34. Here, only one of the oil inlet passage 115 and the first oil supply passage 116 may be arranged in the side portion of the transmission case 34.

The oil supply device 99 preferably further includes a second oil supply passage 120 arranged on the axis 28 of the first and the second power transmission shaft 48, 49; a third oil supply passage 121 arranged in the transmission case 34 so that the discharge section of the oil pump 113 is communicated with the second oil supply passage 120; a fourth oil supply passage 122 arranged on the second power transmission shaft 49 so that a top section of the second oil supply passage 120 is communicated with the upper planetary gear train 51 and the first clutch 66 of the supplied section 98; a fifth oil supply passage 123 arranged on the second power transmission shaft 49 and in the transmission case 34 so that the bottom section of the second oil supply passage 120 is communicated with the lower planetary gear train 52 and the second and the third clutches 67, 68.

Figure 5:
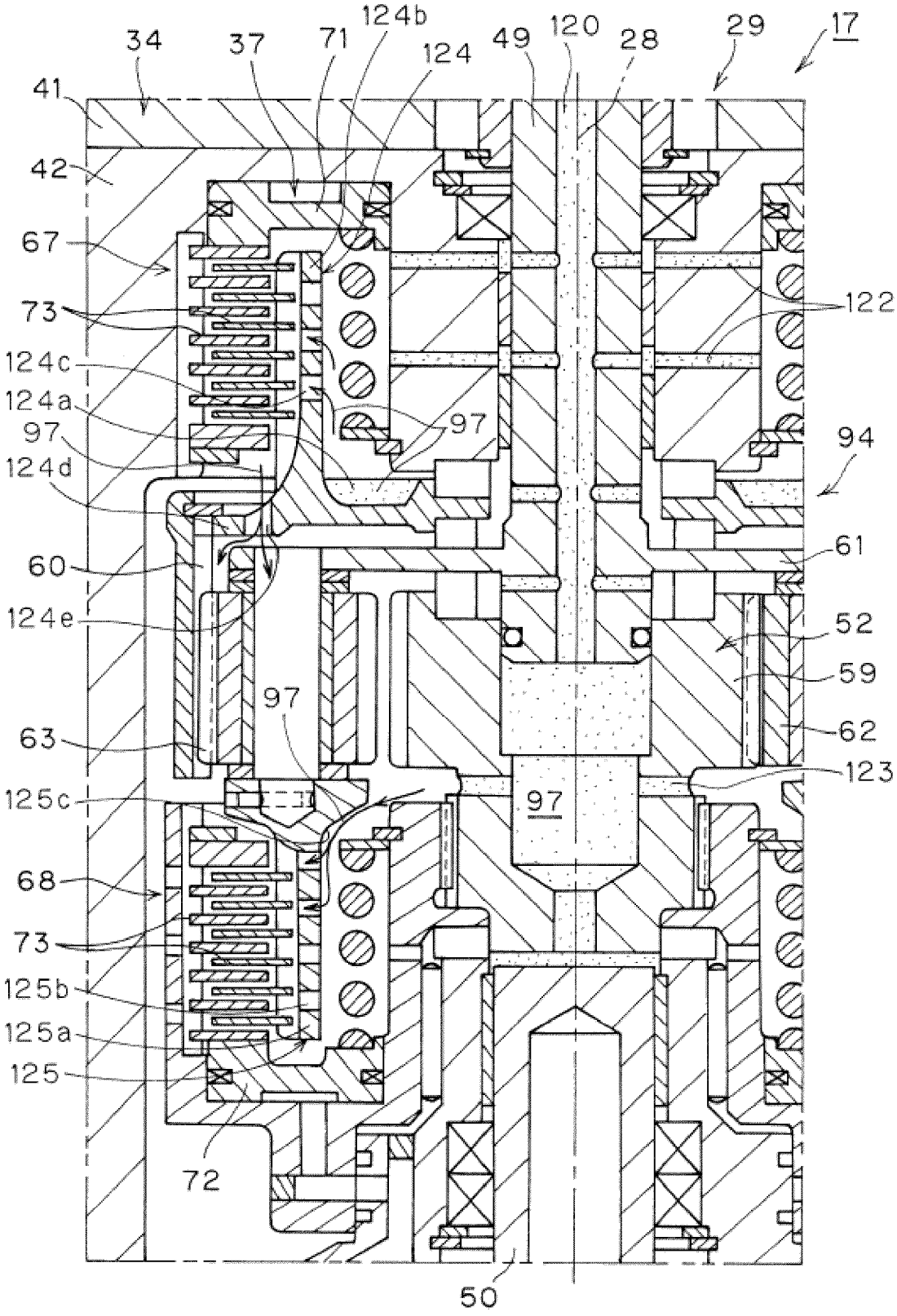
FIG. 5 is an enlarged sectional view showing a portion of FIG. 4.

Especially, as seen in FIG. 5, the second clutch 67 includes a clutch rotating body 124 rotatable about the axis 28 and the plurality of clutch plates 73. The plurality of clutch plates 73 is fitted onto the clutch rotating body 124 for movement in an axial direction, and is capable of engaging and disengaging the clutch rotating body 124 with/from the transmission case 34, which is a portion of the transmission 37 that corresponds to the clutch rotating body 124, by the above movement. A portion of these clutch plates 73 is engaged with an outer peripheral surface of the clutch rotating body 124 to be slidable only in the axial direction, and the other portion thereof is engaged with an inner peripheral surface of the transmission case 34 to be slidable only in the axial direction. The portion and the other portion of the clutch plates 73 are alternately arranged in the axial direction.

The clutch rotating body 124 preferably has a bowl shape that opens upward. The clutch rotating body 124 includes an oil reservoir 124*a* arranged to hold lubricating oil 97 that is arranged in an inner bottom portion thereof and a peripheral wall 124*b* that covers the oil reservoir 124*a* from the outside in the radial direction and fits to each of the clutch plates 73 to allow the axial movement of the clutch plates 73. In addition, a plurality of (preferably three) communicating holes 124*c* is arranged in the vertical direction and is in communication with the oil reservoir 124*a* side and the outside of the clutch rotating body 124 in the radial direction (the clutch plates 73 side). Each of the communicating holes 124*c* is arranged in an area between a topmost clutch plate and a bottommost clutch plate of the plurality of clutch plates 73. Only a fraction of the communicating holes may be arranged in the above area.

An outward-directed flange 124*d* is integrally arranged on the outer surface at the bottom of the peripheral wall 124*b*. The flange 124*d* is configured such that gear teeth arranged on the periphery of the outward-directed flange 124*d* mesh with an upper end portion of the ring gear 60 of the lower planetary gear train 52 so as to permit the clutch rotating body 124 and the ring gear 60 to integrally rotate about the axis 28. An oil pit 124*e* is arranged in the outward-directed flange 124*d* to allow the lubricating oil 97 to drop from an area right outside the peripheral wall 124*b* of the clutch rotating body 124.

The third clutch 68 includes a clutch rotating body 125 rotatable about the axis 28 and the plurality of clutch plates 73 fitted onto the clutch rotating body 125 to permit axial movement. The other portion of the transmission 37, which corresponds to the clutch rotating body 125, is the sun gear 59 of the lower planetary gear train 52. Each of the clutch plates 73 has the same arrangement and function as the one for the second piston 71. The clutch rotating body 125 is in an inverted bowl shape that opens downward. In a peripheral wall 125*a* of the clutch rotating body 125, a plurality of (four) communicating holes 125*b* is vertically arranged to communicate from the inner side of the peripheral wall 125*a* to the outside of the clutch rotating body 125 in the radial direction (the clutch plates 73 side). Each of the communicating holes 125*b* is arranged between a topmost clutch plate and a bottommost clutch plate of the plurality of clutch plates 73.

A ceiling surface in a bottom (upper) portion of the clutch rotating body 125 is arranged with a guide surface 125*c* that declines toward the peripheral wall 125*a* of the clutch rotating body 125 in the radial direction. This guide surface 125*c* guides the oil 97, which passes from the second oil supply passage 120 to the fifth oil supply passage 123 and is supplied to the upper portion of the clutch rotating body 125, to the communicating holes 125*b*.

The operation of the oil supply device 99 to supply the oil 97 will now be described.

When the oil pump 113 is activated in conjunction with the engine 15, the oil 97 in the oil pan 110 sequentially passes through the oil filter 112 and the inlet port 111 to be suctioned into the oil pump 113.

Then, a portion of the oil 97 that is pressurized by the oil pump 113 and then discharged therefrom is supplied to the engine 15 for lubrication. Another portion of the discharged oil 97 is supplied to the first to the third hydraulically-controlled valves 101 to 103 through the first oil supply passage 116. With the control of an unillustrated transmission control device by a crew member, each of the hydraulically-controlled valves 101 to 103 is operated, and the oil 97 is supplied to the hydraulic chambers corresponding to the first to the third pistons 70 to 72. Then, the given operation is carried out. After this operation, the oil 97 discharged from each of the hydraulic chambers is returned to the oil pan 110 either directly or through the oil return passage 117.

Another portion of the oil 97 that is discharged from the oil pump 113 passes through the third oil supply passage 121, the second oil supply passage 120, and the fourth oil supply passage 122 and then lubricates the upper planetary gear train 51 and the first clutch 66. After lubricating these portions, the oil 97 is returned to the oil pan 110 through the oil return passage 117 while avoiding the lower planetary gear train 52. The other portion of the oil 97 passes from the second oil supply passage 120 to the fifth oil supply passage 123 and then lubricates the lower planetary gear train 52, and the second and the third clutches 67, 68. After the above lubrication, the oil 97 does not pass through the oil return passage 117 but is directly returned to the oil pan 110.

As shown in FIGS. 3, 4, 6 to 8, 10 to 12, a water cooling system 127 arranged to cool each component with cooling water 126 is provided in the marine propulsion unit 4.

The water cooling system 127 is supported on an outer surface in the other side portion (right side portion) of the first case 40 of the transmission case 34. The water cooling system 127 preferably includes a water pump 128 that interlocks with the engine 15 through the first power transmission shaft 48; a water intake passage 129 arranged in the transmission case 34 such that the front portion of the lower case 22 into which the water 2 can flow is communicated with an intake section of the water pump 128; and a cooling water passage 130 arranged in the transmission case 34 to extend from a discharge section of the water pump 128 to the bottom portion of the transmission case 34.

In the plan sectional view of the transmission unit 29 at the middle thereof in the axial direction (especially in FIG. 11), a cooling water passage 130*a*, which is a portion of the cooling water passage 130, is arranged in the other side (right side) portion of the transmission case 34, and a cooling water passage 130*b*, which is the other portion of the cooling water passage 130, is arranged in the rear portion of the transmission case 34. In addition, a lower end portion of the cooling water passage 130 is U-shaped in a plan sectional view of the case bottom 43 of the transmission unit 29 (in FIG. 12), and is arranged almost in the entire area of the case bottom 43. One end of the U-shaped cooling water passage 130 is communicated with an area below the transmission case 34 by a drain hole 131 arranged in the bottom portion of the transmission case 34.

When the water pump 128 is activated in conjunction with the engine 15, the water 2 is suctioned into the water pump 128 through the front portion of the lower case 22 and the water intake passage 129. Then, the water 2 suctioned in the water pump 128 is supplied to the cooling water passage 130 to water-cool the transmission unit 29. After cooling the transmission unit 29, the water 2 passes through the drain hole 131 of the cooling water passage 130 in the transmission unit 29 and is discharged to the outside below the drain hole 131.

In the plan sectional view of the transmission unit 29 at the middle in the axial direction (especially in FIG. 11), the cooling water passage 130*a*, which is a portion of the cooling water passage 130, is arranged in the other side (right side) portion of the transmission case 34, and the cooling water passage 130*b*, which is the other portion of the cooling water passage 130, is arranged in the rear portion of the transmission case 34. In this case, the cooling water passage 130 may be arranged in the side (left side) portion of the transmission case 34, or may be arranged in one of the side portions or in the rear portion of the transmission case 34. At this time, a total cross-sectional area S1 of the cooling water passage 130 in front of the axis 28 of the transmission case 34 is preferably smaller than a total cross-sectional area S2 of the cooling water passage 130 behind the axis 28 (S1<S2).

In addition, in the plan sectional view of the transmission unit 29 (especially in FIG. 11), a cross-section of the oil return passage 117 has a curved shape that follows a cross-section of the other side portion of the transmission case 34. More specifically, in the plan sectional view of the transmission unit 29 (especially in FIG. 11), the cross-section of the other side portion of the transmission case 34 has approximately an arc shape with the axis 28 as its center. Then, the cooling water passage 130 is arranged in the arc shape on a first arcuate line 134 with a first radius R1 about the axis 28. Meanwhile, axes of the front bolts 35 are located on a second arcuate line 135 with a second radius R2 about the axis 28. The second radius R2 is preferably smaller than the first radius R1 (R2<R1).

Figure 3:
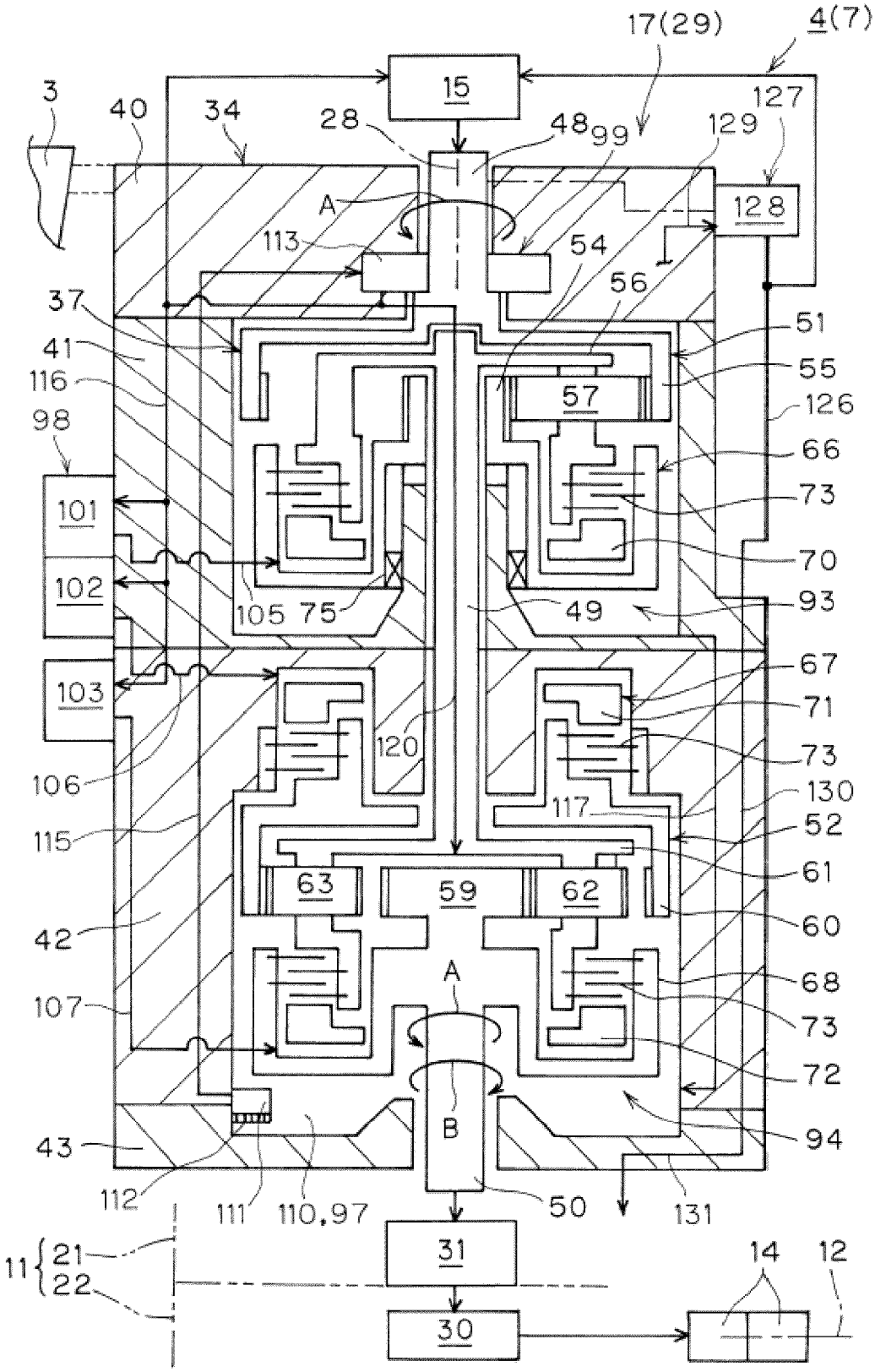
FIG. 3 is a simplified diagrammatic view of the marine propulsion unit.

Referring to FIGS. 3, 17, a speed change operation by the speed change section 93 and the rotational direction switching section 94 of the transmission unit 29 of the power transmission system 17 will now be described.

First, the first clutch 66 and the second clutch 67 are adapted to be in the disengaged state, and the third clutch 68 is adapted to be in the engaged state. This brings the power transmission device 17 to a speed change state of "slow forward travel."

That is, during the disengaged state of the first clutch 66, if the ring gear 55 of the upper planetary gear train 51 operates in the forward rotation A together with the first power transmission shaft 48 by the output from the engine 15, the sun gear 54 attempts to operate in the reverse rotation B through the planetary gear 57. However, the reverse rotation B of the sun gear 54 is inhibited by the one-way clutch 75. Therefore, the forward rotation A of the ring gear 55 is decelerated through the planetary gear 57 and the carrier 56, and then is transmitted to the second power transmission shaft 49. Consequently, the second power transmission shaft 49 operates in the forward rotation A at a low speed.

Then, the carrier 61 of the lower planetary gear train 52 operates in the forward rotation A at the low speed along with the second power transmission shaft 49. In addition, the third power transmission shaft 50 that is unified with the carrier 61 due to the engaged state of the third clutch 68, which is described above, operates in the forward rotation A at the low speed. This brings the power transmission system 17 to the speed change state of "slow forward travel." Then, the forward rotation A of the third power transmission shaft 50 is transmitted to each of the propellers 14 through the speed change device 31, the interlocking device 30, and each of the propeller shafts 13 in sequence to permit "slow forward travel" of the boat 1.

Second, the first clutch 66 and the third clutch 68 are adapted to be in the engaged state while the second clutch 67 is adapted to be in the disengaged state. This brings the power transmission device 17 to the speed change state of "fast forward travel."

More specifically, as described above, when the first clutch 66 is engaged, the components 54 to 57 of the upper planetary gear train 51 operate integrally in the forward rotation A. This brings the second power transmission shaft 49 to be directly connected to the engine 15 through the first power transmission shaft 48. Thus, the second power transmission shaft 49 operates in the forward rotation A at the high speed.

Consequently, the carrier 61 of the lower planetary gear train 52 operates in the forward rotation A at the high speed along with the second power transmission shaft 49. In addition, the third power transmission shaft 50 unified with the carrier 61 due to the engaged state of the third clutch 68, which is described above, operates in the forward rotation A at the high speed. This brings the power transmission system 17 to the speed change state of "fast forward travel." Then, the forward rotation A of the third power transmission shaft 50 is transmitted to each of the propellers 14 through the speed change device 31, the interlocking device 30, and each of the propeller shafts 13 in sequence to permit "fast forward travel" of the boat 1.

Third, the first clutch 66, the second clutch 67, and the third clutch 68 are all adapted to be in the disengaged state. This brings the lower planetary gear train 52 to an idling state although the upper planetary gear train 51 operates in the forward rotation A at the low speed. Consequently, the power transmission system 17 comes into the speed change state of "neutral," and the propellers 14 rotate freely. It should be noted, however, that the above "neutral" state can be attained even though the first clutch 66 is engaged as long as the second clutch 67 and the third clutch 68 are disengaged.

Fourth, the first clutch 66 and the third clutch 68 are adapted to be in the disengaged state, and the second clutch 67 is adapted to be in the engaged state. This brings the power transmission device 17 to the speed change state of "slow reverse travel."

In other words, due to the disengaged state of the first clutch 66, the second power transmission shaft 49 operates in the forward rotation A at the low speed as in the speed change state of the "slow forward travel."

Then, the carrier 61 of the lower planetary gear train 52 operates in the forward rotation A at the low speed along with the second power transmission shaft 49. At this time, the ring gear 60 of the lower planetary gear train 52 is secured to the transmission case 34 due to the engaged state of the second clutch 67. In contrast, due to the disengaged state of the third clutch 68, the forward rotation A of the carrier 61 is reversed through the planetary gear 63 and the planetary gear 62 in sequence, and causes the third power transmission shaft 50 to operate in the reverse rotation B at the low speed. This brings the power transmission system 17 to the speed change state of "slow reverse travel." Then, the reverse rotation B of the third power transmission shaft 50 is transmitted to each of the propellers 14 through the speed change device 31, the interlocking device 30, and each of the propeller shafts 13 in sequence to permit "slow reverse travel" of the boat 1.

Fifth, the first clutch 66 and the second clutch 67 are adapted to be in the engaged state while the third clutch 68 is adapted to be in the disengaged state. This brings the power transmission device 17 to the speed change state of "fast reverse travel."

In other words, due to the engaged state of the first clutch 66, the second power transmission shaft 49 operates in the forward rotation A at the high speed as in the speed change state of the "fast forward travel."

Consequently, the carrier 61 of the lower planetary gear train 52 operates in the forward rotation A at the high speed along with the second power transmission shaft 49. At this time, due to the engaged state of the second clutch 67, the ring gear 60 of the lower planetary gear train 52 is secured to the transmission case 34. In contrast, due to the disengaged state of the third clutch 68, the forward rotation A of the carrier 61 is reversed through the planetary gear 63 and the planetary gear 62 in sequence, and causes the third power transmission shaft 50 to operate in the reverse rotation B at the high speed. This brings the power transmission system 17 to the speed change state of "fast reverse travel." Then, the forward rotation A of the third power transmission shaft 50 is transmitted to each of the propellers 14 through the speed change device 31, the interlocking device 30, and each of the propeller shafts 13 in sequence to permit "fast reverse travel" of the boat 1.

According to the above arrangement, the clutch rotating body 124 includes the oil reservoir 124*a* for the lubricating oil 97 that is arranged in the inner bottom portion thereof and the peripheral wall 124*b* that covers the oil reservoir 124*a* from the outside in the radial direction and fits to each of the clutch plates 73 for the axial movement of the clutch plates 73. In addition, the communicating holes 124*c* are arranged in the peripheral wall 124*b* of the clutch rotating body 124 to be in communication with the oil reservoir 124*a* side and the outside of the clutch rotating body 124 in the radial direction.

Due to the above arrangement, the oil 97 is stored in the oil reservoir 124*a*. Thus, even when the engine 15 is activated after a long stopped period of the marine propulsion unit 4, along with the rotation of the clutch rotating body 124 that interlocks with the engine 15, the oil 97 in the oil reservoir 124*a* is immediately sprayed outwardly in the radial direction from the oil reservoir 124*a* due to centrifugal force. Then, the oil 97 passes through the communicating holes 124*c* and is directed to the clutch plates 73 located outside the peripheral wall 124*b* of the clutch rotating body 124 in the radial direction, and immediately lubricates the clutch plates 73. Therefore, the early deterioration of each of the clutch plates 73 at an early stage is prevented.

As described above, the clutch rotating body 124 has a bowl shape that opens upward. The oil reservoir 124*a* is arranged in the bottom portion of the clutch rotating body 124, and the plurality of communicating holes 124*c* is arranged in the peripheral wall 124*b* of the clutch rotating body 124.

Accordingly, the clutch rotating body 124 employs a simple structure in a bowl shape that opens upward. Also, the structure of this clutch rotating body 124 is used for the fabrication of the oil reservoir 124*a*. Therefore, the lubrication of each of the clutch plates 73 can be carried out in a simple arrangement. In addition, since the plurality of communicating holes 124*c* is arranged in the peripheral wall 124*b* of the clutch rotating body 124, each of the clutch plates 73 is lubricated evenly with the oil 97 that passes through each of the communicating holes 124*c* and is directed to each of the clutch plates 73. Therefore, the deterioration of these clutch plates 73 is thoroughly prevented.

As described above, the oil pit 124*e* is provided such that it can drop the oil 97 from the area right outside the peripheral wall 124*b* of the clutch rotating body 124 in the radial direction.

Due to the above arrangement, the oil 97, which passes through the communicating holes 124*c* and is directed to the outside of the peripheral wall 124*b* of the clutch rotating body 124 in the radial direction, passes through the oil pit 124*e* in the early stage after passing the communicating holes 124*c* and drops. Therefore, despite the fact that the oil 97 tends to be directed outward in the radial direction due to the centrifugal force, because the oil 97 passes through the oil pit 124*e* and drops in the early stage as described above, the radially inner portion of the lower planetary gear train 52 and that of the third clutch 68, which are both the supplied section 98 of the oil 97 that is disposed below the clutch rotating body 124, can be reliably lubricated with the oil 97. As a result, each component of the power transmission system can be lubricated evenly.

As described above, the communicating holes 124*c* are arranged between the topmost clutch plate and the bottommost clutch plate of the plurality of clutch plates 73.

Due to the above arrangement, as described above, when the oil 97 passes through the communicating holes 124*c* and is directed to radially outside of the clutch rotating body 124 in conjunction with the rotation of the clutch rotating body 124 at startup of the engine 15, the oil 97 is directly transferred to each of the clutch plates 73 to lubricate these clutch plates 73. Therefore, since these clutch plates 73 are lubricated promptly once the clutch rotating body 124 starts rotating, the deterioration of these clutch plates 73 can be reliably prevented.

Alternatively, a multi-plate clutch may be provided instead of the one-way clutch 75.

According to the above arrangement, the oil return passage 117 is provided such that it returns the oil 97, which has lubricated the upper planetary gear train 51, to the oil pan 110 while avoiding the lower planetary gear train 52.

Due to the above arrangement, the oil 97, which has lubricated the upper planetary gear train 51, is prevented from being supplied to the lower planetary gear train 52 located under the upper planetary gear train 51. Accordingly, the oil 97 that has lubricated the upper planetary gear train 51 is prevented from being supplied to the rotating bodies of the lower planetary gear train 52, such as the sun gear 59 and the ring gear 60. The oil 97 is also prevented from the unnecessary linkage rotation with these rotating bodies. Therefore, it is possible to prevent a power loss in the engine 15 and a decline in the fuel efficiency caused by this linkage rotation.

As described above, the transmission case 34 is provided in a manner that it is housed in the case 11 and covers the lower planetary gear train 52. The oil return passage 117 is arranged in the side portion of this transmission case 34.

Here, since the transmission case 34 is large and arranged in a shape to cover the lower planetary gear train 52, the cross-sectional area of the oil return passage 117, which is arranged in the transmission case 34, can be enlarged. Due to the above arrangement, the oil 97 that has lubricated the upper planetary gear train 51 can be efficiently collected in the oil pan 110 through the oil return passage 117.

Therefore, since the oil return passage 117 is arranged in the lateral portion of the transmission case 34 in the plan sectional view of the transmission case 34, it is possible to minimize the forward expansion of the front outer surface of the transmission case 34. In addition, the above minimization also makes it possible to minimize the forward expansion of the front outer surface of the case 11 housing the transmission case 34.

Accordingly, while the contact of the rear portion of the hull 3 with the front outer surface of the case 11 is avoided, the center of mass of the marine propulsion unit 4 can be closer to the rear portion of the hull 3. As a result, it is possible to reduce the magnitude of support moment generated when the rear portion of the hull 3 supports the marine propulsion unit 4; therefore, the load in intensity on the rear portion of the hull 3 can be reduced.

In other words, even when the oil 97 is effectively collected in the oil pan 110 through the oil return passage 117 due to the enlargement of the cross-section of the oil return passage 117 in a plan sectional view of the transmission case 34, it is possible to reduce the load in intensity on the rear portion of the hull 3 that supports the marine propulsion unit 4.

As described above, the upper planetary gear train 51 and the lower planetary gear train 52 are disposed on the same axis 28 that extends in the vertical direction. The second power transmission shaft 49 is provided on the axis 28 of the upper planetary gear train 51, and is arranged with the second oil supply passage 120 that extends along the axial direction of the second power transmission shaft 49. The lubricating oil 97 is supplied to the lower planetary gear train 52 through the second oil supply passage 120.

Due to the above arrangement, the supply of the oil 97 to the lower planetary gear train 52 through the second oil supply passage 120 can be carried out without the intervention of the upper planetary gear train 51. In addition, the oil 97 is supplied to the rotational center of the lower planetary gear train 52. Therefore, the oil 97 is supplied to the lower planetary gear train 52 in the appropriate amount, and the oil 97 supplied to the rotational center of the lower planetary gear train 52 is then supplied to the radial outside thereof due to the centrifugal force. As a result, the lubrication of the lower planetary gear train 52 can be evenly carried out.

A preferred embodiment of the present invention also preferably includes the right and left front bolts 35 that extend vertically to fasten the front portion of the transmission case 34 to the case 11; and the right and left rear bolts 36 that extend vertically to fasten the rear portion of the transmission case 34 to the case 11. The width dimension W1 between the right and the left front bolt 35, 35 is larger than the width dimension W2 between the right and the left rear bolt 36, 36 in the width direction of the hull 3.

Due to the above arrangement, the right and the left front bolt 35, 35 can be respectively positioned in the right side portion and the left side portion of the transmission case 34. Consequently, it is possible to minimize the forward expansion of the front outer surface of the transmission case 34 for the disposition of each of the front bolts 35. In addition, the above minimization also makes it possible to minimize the forward expansion of the front outer surface of the case 11 housing the transmission case 29.

Therefore, for the same reason as above, it is possible to reduce the load in intensity on the rear portion of the hull 3.

The cooling water passage 130*a*, which is arranged in the side portion of the transmission case 34 to run the cooling water 126, is located outside the oil return passage 117.

Due to the above arrangement, the oil 97 in the oil return passage 117 can be cooled directly and effectively with the cooling water 126 flowing through the cooling water passage 130*a*. Therefore, the degradation of the oil 97 can be reliably prevented.

In addition, as described above, the cooling water passage 130*a* arranged in the side portion of the transmission case 34 is located outside the oil return passage 117.

First, due to the above arrangement, since the cooling water passage 130*a* is located closer to the outer surface of the transmission case 34 than the oil return passage 117, it is possible to extend the cooling water passage 130*a*. Therefore, with the extension of the cooling water passage 130*a*, it is possible to increase a quantity of the cooling water 126 that flows through the cooling water passage 130*a*, and thus, the oil 97 in the oil return passage 117 can be sufficiently cooled.

Second, in the case 11, the exhaust passage 20 is preferably arranged right outside the transmission case 34, and the exhaust gases 19 flow through the exhaust passage 20. Meanwhile, as described above, the cooling water passage 130*a* is located on the outside of the oil return passage 117. Therefore, with the cooling water 126 flowing through the cooling water passage 130*a*, it is possible to prevent the oil 97 flowing through the oil return passage 117 from being heated by exhaust heat of the exhaust gases 19.

The area of the cooling water passage 130 is larger than that of the oil return passage 117 in the plan sectional view of the transmission case 34.

Therefore, it is possible to increase the quantity of the cooling water 126 that flows through the cooling water passage 130, and thus, the oil 97 flowing through the oil return passage 117 can be sufficiently cooled with the cooling water 126.

As described above, the cooling water passage 130 and the oil return passage 117 are arranged in arc shapes that follow the lateral wall of the transmission case 34. The transmission case 34 and the lower planetary gear train 52 share the common axis 28 that extends in the vertical direction. The arc of the cooling water passage 130 around the axis 28 is longer than that of the cooling water passage 130 around the axis 28 in the plan sectional view of the transmission case 34.

Due to the above arrangement, the cross-sectional area of the cooling water passage 130 can further be enlarged. Therefore, it is possible to increase the quantity of the cooling water 126 that flows through the cooling water passage 130, and thus, the oil 97 in the oil return passage 117 can be sufficiently cooled with the cooling water 126.

The transmission case 34 may be integrally arranged with the case 11. Also, the top plate 24 of the lower case 22 and the lower case body 25 may be integrally arranged with each other. In addition, a multiplate clutch may be provided instead of the one-way clutch 75. Moreover, the cooling water passages 130*a*, 130*b* may be continuous with each other in the plan sectional view of the transmission unit 29.

In the case where the oil 97, which has lubricated the upper planetary gear train 51, is returned to the oil pan 110 through the oil return passage 117 while avoiding the lower planetary gear train 52, the oil 97 may flow into the lower portion of the lower planetary gear train 52 through this oil return passage 117 while avoiding the upper portion of the lower planetary gear train 52. Then, the oil 97 may be returned to the oil pan 110 through the lower portion of the lower planetary gear train 52. In addition, the oil return passage 117 may be fabricated by forming a vertical groove on the inner surface of the transmission case 34 and then closing an opening of this vertical groove. Or, the oil return passage 117 may be arranged with a pipe member.

Figure 13:
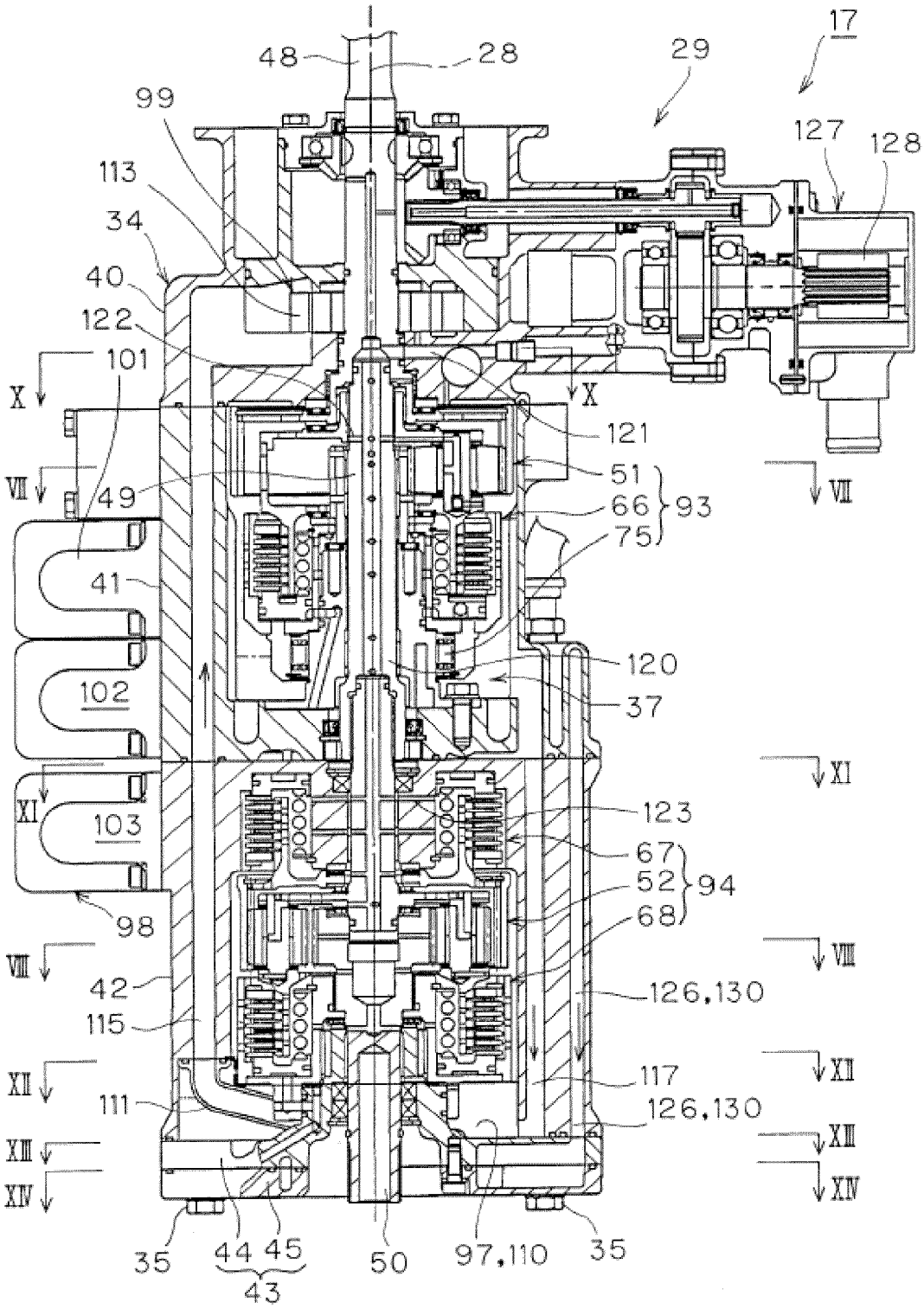
FIG. 13 is an enlarged sectional rear view of the transmission unit.
Figure 14:
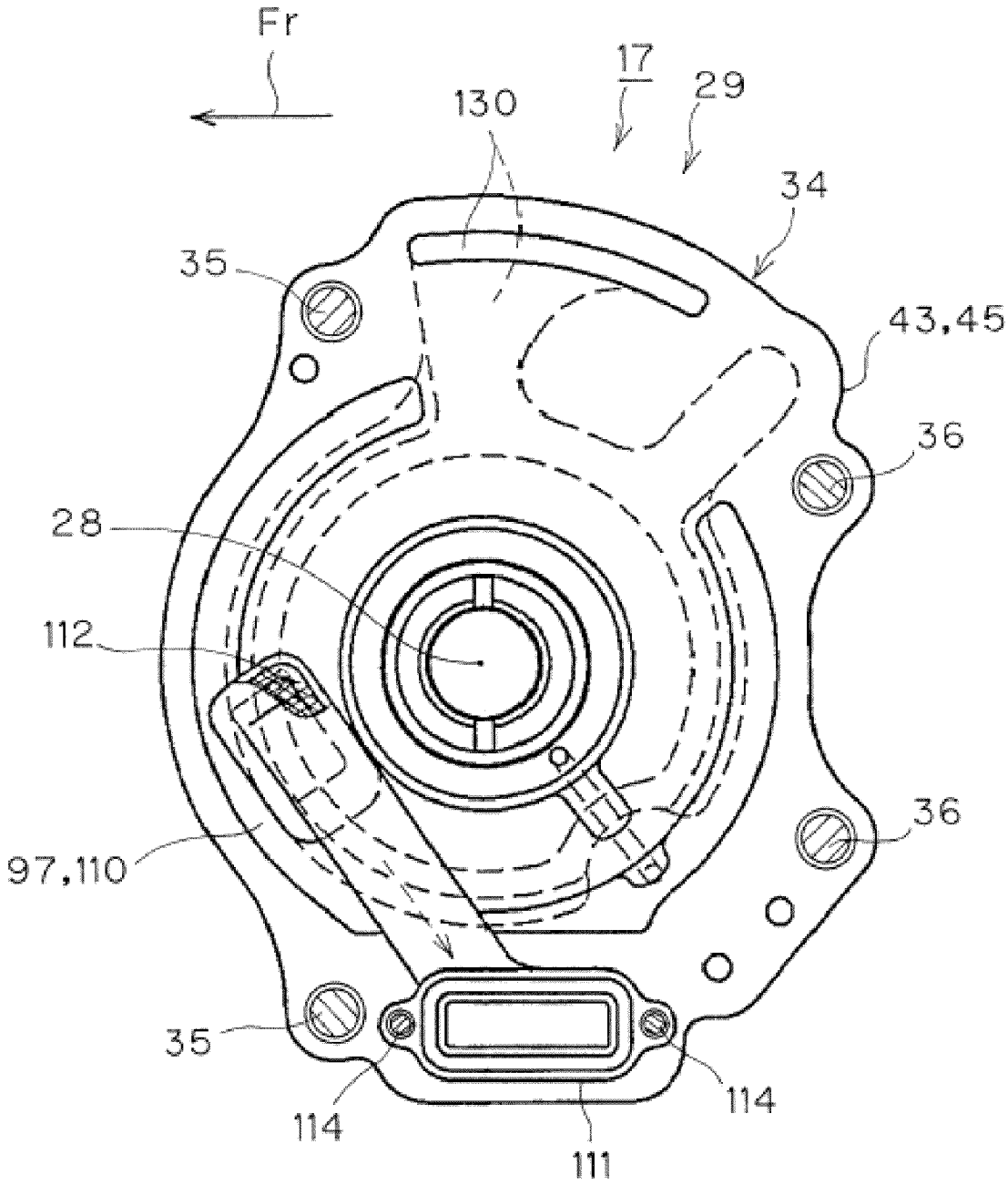
FIG. 14 is a sectional view taken along the line XII-XII of FIG. 13.
Figure 15:
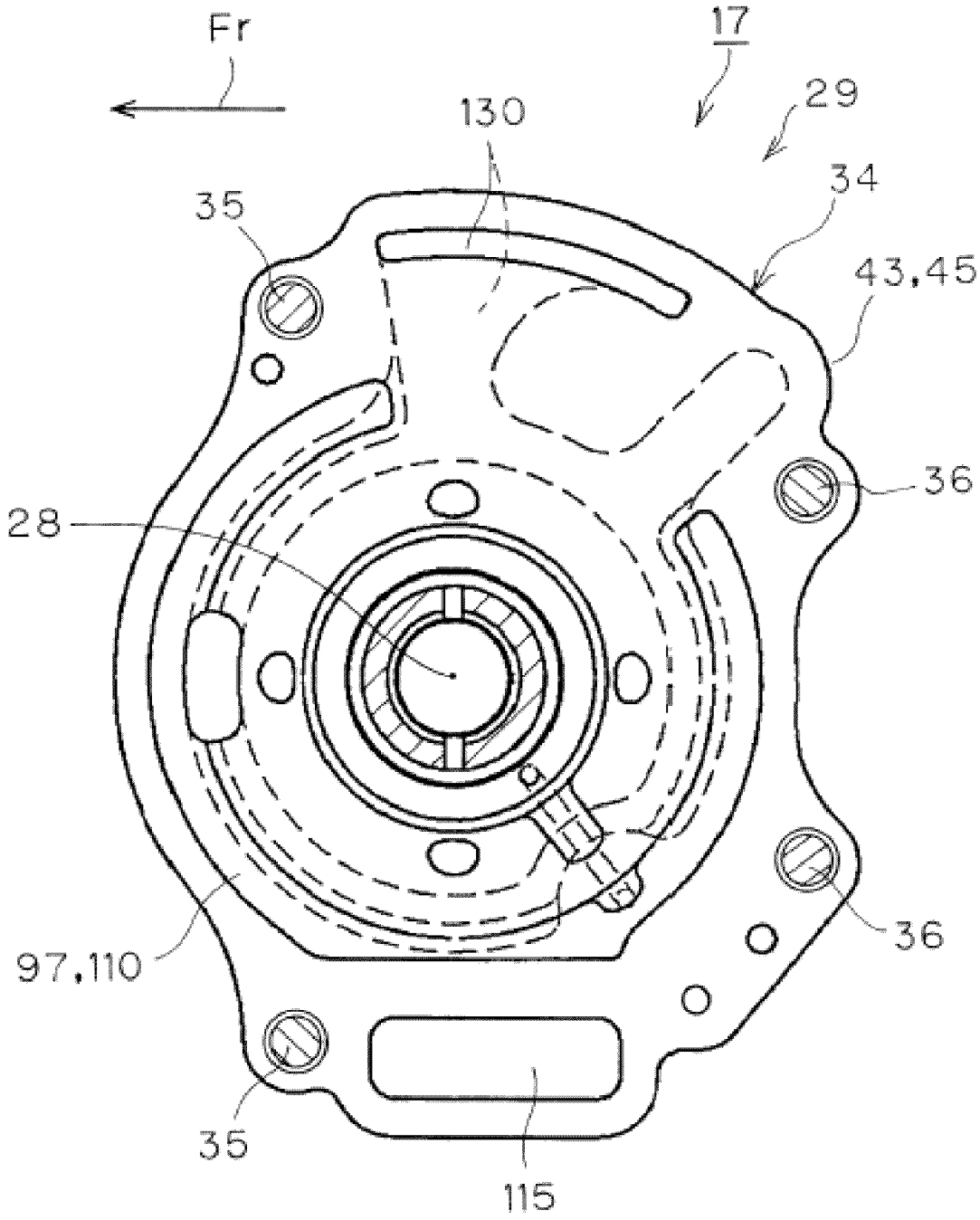
FIG. 15 is a sectional view taken along the line XIII-XIII of FIG. 13.
Figure 16:
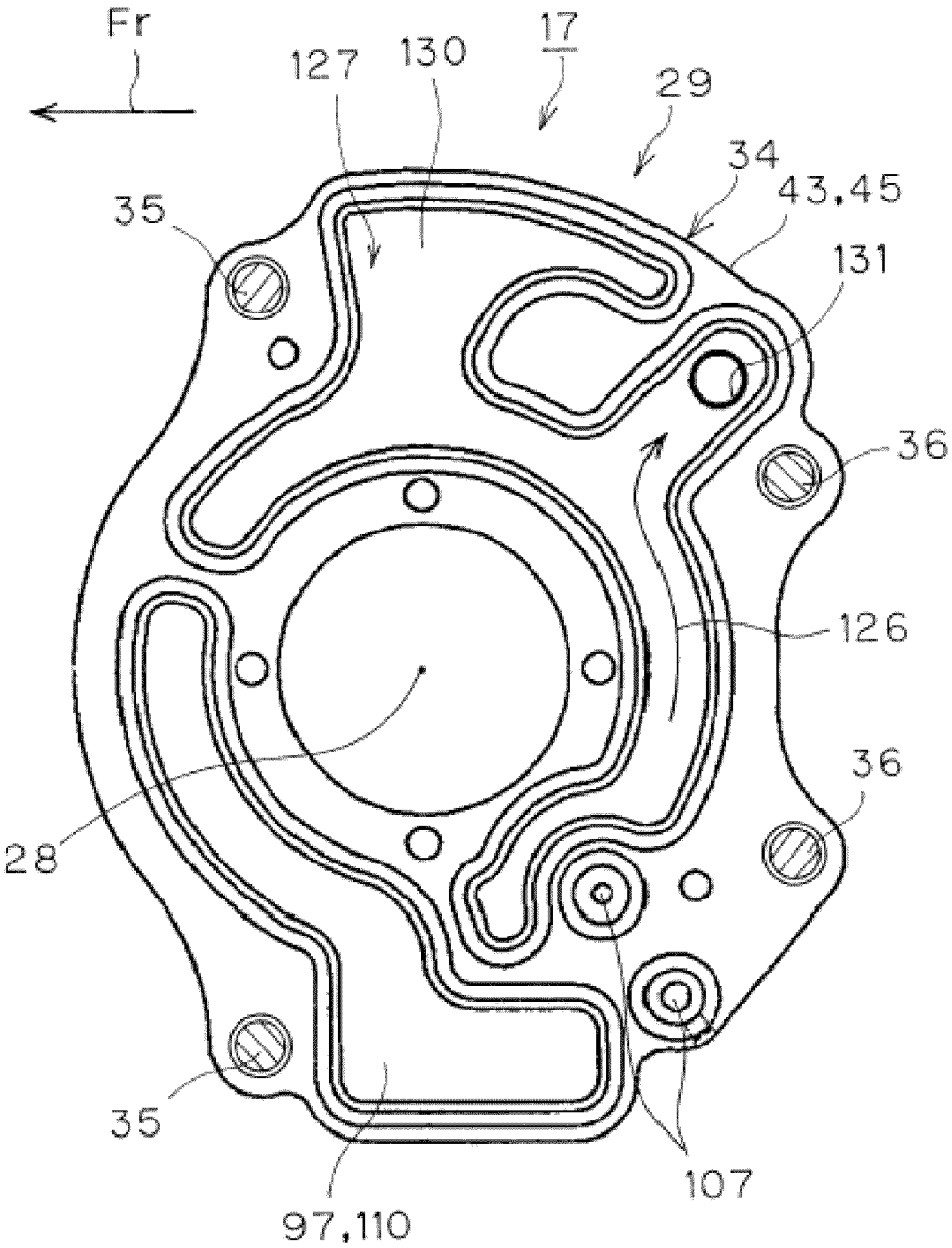
FIG. 16 is a sectional view taken along the line XIV-XIV of FIG. 13.

In FIGS. 3 to 8, 13 to 16, the transmission case 34 includes the oil pan 110, the inlet port 111, the oil pump 113, the oil inlet passage 115, and the first oil supply passage 116. Here, FIG. 13 shows the cross-section of the transmission unit that is a different portion from the one shown in FIG. 4, and omits the speed reduction device. The oil pan 110 is arranged in the case bottom 43 of the transmission case 34. The inlet port 111 is disposed in the front portion of the oil pan 110. The oil pump is provided in the upper portion of the transmission case 34. The oil inlet passage is arranged in the transmission case 34 such that the front portion of the oil pan 110 is communicated with the inlet section of the oil pump 113 through the inlet port 111. The first oil supply passage 116 is arranged in the transmission case 34 such that the discharge section of the oil pump 113 is communicated with the supplied section 98 of the oil 97.

Due to the above arrangement, once the oil pump 113 is activated, the oil 97 in the oil pan 110 is suctioned into the oil pump 113 through the inlet port 111 and the first oil supply passage 116 in sequence. Then, the oil 97 discharged from this oil pump 113 is supplied to the supplied section 98 through the first oil supply passage 116 to lubricate the supplied section 98.

As described above, the oil pan 110 is arranged in the case bottom 43 of the transmission case 34, and the oil pump 113 is provided in the upper portion of the transmission case 34. In addition, the oil inlet passage 115 and the first oil supply passage 116 are also arranged in the transmission case 34.

Therefore, since the oil inlet passage 115 and the first oil supply passage 116 are arranged in the transmission case 34 of the transmission unit 29, neither pipe materials nor piping is necessary to fabricate the oil inlet passage 115 and the first oil supply passage 116. Furthermore, the oil inlet passage 115 and the first oil supply passage 116 are arranged compactly so as to be directly connected to the oil pan 110 and the oil pump 113.

As a result, first, it is possible to easily fabricate the oil inlet passage 115 and the first oil supply passage 116 that can supply the lubricating oil 97 to the transmission unit 29 contained in the case 11 of the marine propulsion unit 4. Secondly, as described above, since the oil inlet passage 115 and the first oil supply passage 116 are compact, the total amount of the oil 97 utilized in the transmission unit 29 can be small. Therefore, it is possible to prevent power loss of the engine 15 and a decline in fuel efficiency caused by the unnecessary linkage rotation of the oil 97 with each rotating body of the transmission 37.

Meanwhile, as described above, the inlet port 111 is arranged in the front portion of the oil pan 110. The oil 97 in the oil pan 110 is suctioned into the oil pump 113 through the inlet port 111 and the oil inlet passage 115 in sequence.

Due to the above arrangement, when the case 11 of the marine propulsion unit 4 is tilted along with the propellers 14, the oil 97 tends to concentrate in the front portion of the oil pan 110, which is also tilted jointly. However, the oil 97 is effectively suctioned into the oil pump 113 through the inlet port 111 and the oil inlet passage 115 in sequence, and then is supplied to the supplied section 98 of the transmission unit 29 for lubrication. Therefore, even when the case 11 is tilted, the lubrication in the transmission unit 29 is effectively carried out.

As described above, the case bottom 43 of the transmission case 34 is separately provided from the upper portions 40 to 42 of the transmission case 34 that are located above. The case bottom 43 is detachably secured to the upper portions 40 to 42.

Due to the above arrangement, servicing such as maintenance of the oil pan 110 can easily be conducted without the intervention of the upper portions 40 to 42 by detaching the case bottom 43 from the upper portions 40 to 42 of the transmission case 34.

As described above, while the case bottom 43 of the transmission case 34 is detached from the upper portions 40 to 42 thereof, the inlet port 111 can be detached from the lower surface of the upper portions 40 to 42 of the transmission case 34.

Due to the above arrangement, if the case bottom 43 is arranged to be detached from the upper portions 40 to 42 of the transmission case 34, the inlet port 111 can easily be attached to the lower surface of the upper portions 40 to 42. Therefore, the assembling property of the transmission unit 29 is improved.

As described above, at least one of the oil inlet passage 115 and the first oil supply passage 116 is arranged in either the right side portion or the left side portion of the transmission case 34. The oil return passage 117 that returns the oil 97 having been supplied to the supplied section 98 to the oil pan 110 is arranged in the other side portion of the transmission case 34.

Here, the oil inlet passage 115 and the first oil supply passage 116 are the passages through which the oil 97 is forcibly flowed by the oil pump 113. Thus, even if the cross-sectional area of each of these passages is made smaller to some extent, a desired flow rate can be obtained by increasing the flow speed of the oil 97. On the other hand, the oil 97 naturally flows down by its own weight in the oil return passage 117, the cross-sectional area of the oil return passage 117 has to be relatively large for the smooth downward flow of the oil 97.

As described above, the oil return passage 117 and at least one of the oil inlet passage 115 and the first oil supply passage 116 are separately disposed in the right and the left side portion of the transmission case 34. According to this arrangement, the cross-sectional areas of the side portions of the transmission case 34 can be finely balanced. Then, as described above, each of the passages 115 to 117 is separately disposed in the right and the left side portions of the transmission case 34. Consequently, it is possible to minimize the forward expansion of the front outer surface of the transmission case 34 of the transmission unit 29 in the plan sectional view of the transmission unit 29. In addition, the above minimization also makes it possible to minimize the forward expansion of the front outer surface of the case 11 housing the transmission unit 29.

Accordingly, while the contact of the rear portion of the hull 3 with the front outer surface of the case 11 is avoided, the center of mass of the marine propulsion unit 4 can be closer to the rear portion of the hull 3. As a result, it is possible to reduce the magnitude of the support moment generated when the rear portion of the hull 3 supports the marine propulsion unit 4; therefore, the load in intensity on the rear portion of the hull 3 can be reduced.

In other words, even when the oil 97 flows effectively through each of the passages 115 to 117 due to the maximum enlargement of the cross-sectional area of each of the passages 115 to 117 in the plan sectional view of the transmission unit 29, it is possible to reduce the load in intensity on the rear portion of the hull 3 that supports the marine propulsion unit 4 as described above.

As described above, in the plan sectional view of the transmission unit 29 (especially in FIG. 11), the cross-section of the oil return passage 117 has a curved shape that follows the cross-sectional shape of the other side portion of the transmission case 34.

Due to the above arrangement, it is possible to enlarge the cross-sectional area of the oil return passage 117 while avoiding a decline in strength of the other side portion of the transmission case 34, which can be caused by the fabrication of the oil return passage 117. Therefore, when the oil 97 naturally flows down by its own weight in the oil return passage 117, the downward flow thereof can be conducted smoothly and it is preferable for the lubrication thereafter.

As described above, the cooling water passage 130 through which the cooling water 126 flows is preferably arranged in the case bottom 43 of the transmission case 34.

Due to the above arrangement, the oil 97 that is collected in the oil pan 110 arranged in the case bottom 43 of the transmission case 34 is directly and effectively cooled with the cooling water 126 that flows through the cooling water passage 130. Therefore, the degradation of the oil 97 can be reliably prevented.

As described above, in the plan sectional view of the transmission unit 29 (especially in FIG. 11), the cooling water passage 130 is preferably arranged on the first arcuate line 134 having the first radius R1 with the axis 28 at its center. The axes of the front bolts 35 are located on the second arcuate line 135 having the second radius R2 with the axis 28 at its center. The first radius R1 is preferably larger than the second radius R2.

Due to the above arrangement, since the cooling water passage 130 can be arranged on the first arcuate line 134 having the first large radius R1 while avoiding the intervention of each of the front bolts 35, the cross-sectional area of the cooling water passage 130 can further be enlarged. Therefore, it is possible to increase the quantity of the cooling water 126 that flows through the cooling water passage 130, and thus, the transmission unit 29 can be sufficiently cooled.

The oil return passage 117 is arranged in the side portion of the transmission case 34 such that the oil 97, which has lubricated the transmission 37 of the transmission unit 29, flows down to the oil pan 110. The cooling water passage 130*a* arranged in the side portion of the transmission case 34 is located outside the oil return passage 117.

Due to the above arrangement, the oil 97 in the oil return passage 117 can be cooled directly and effectively with the cooling water 126 flowing through the cooling water passage 130*a*. Therefore, the degradation of the oil 97 can be reliably prevented.

As described above, the cooling water passage 130*a* arranged in the side portion of the transmission case 34 is located on the outer side of the oil return passage 117.

Due to the above arrangement, first, since the cooling water passage 130*a* is located further away from the axis 28 than the oil return passage 117, the cooling water 130*a* around the axis 28 can be extended. Therefore, with the extension of the cooling water passage 130*a*, it is possible to increase the quantity of the cooling water 126 that flows through the cooling water passage 130*a*, and thus, the oil 97 in the oil return passage 117 can be sufficiently cooled.

Also, in the case 11, the exhaust passage 20 is arranged right outside the transmission case 34 in the radial direction, and the exhaust gases 19 flow through the exhaust passage 20.

Meanwhile, as described above, the cooling water passage 130*a* is located on the outside of the oil return passage 117. Therefore, it is possible to prevent the oil 97 flowing through the oil return passage 117 from being heated by exhaust heat of the exhaust gases 19.

In the plan sectional view of the transmission unit 29 (especially in FIG. 11), the arc of the cooling water passage 130 around the axis 28 in the transmission case 34 is longer than that of the oil return passage 117.

Due to the above arrangement, the cross-sectional area of the cooling water passage 130 can further be enlarged. Therefore, it is possible to increase the quantity of the cooling water 126 that flows through the cooling water passage 130, and thus, the oil 97 in the oil return passage 117 can be sufficiently cooled.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A marine propulsion unit comprising:

a case arranged to be supported by a hull;

a propeller shaft supported in a lower portion of the case;

a transmission housed in the case and arranged to receive an engine output, to change a speed of the output, and to transmit the output;

a transfer device arranged to transfer the output of the transmission to the propeller shaft;

a clutch rotating body including a wet-type multiplate clutch arranged in the transmission and rotatable about an axis extending in a vertical direction;

a plurality of clutch plates on the clutch rotating body and arranged to move in an axial direction so as to be engaged with and disengaged from each other by movement in the axial direction;

an oil reservoir arranged in a bottom portion of the clutch rotating body and arranged to receive lubricating oil;

a peripheral wall arranged radially outside the oil reservoir and fit to each of the clutch plates; and a communicating hole arranged in the peripheral wall of the clutch rotating body to communicate the oil reservoir with an outside of the clutch rotating body in the radial direction.

2. The marine propulsion unit according to claim 1, wherein the clutch rotating body has a bowl shape that opens upward; and a plurality of the communicating holes is arranged in the peripheral wall of the clutch rotating body.

3. The marine propulsion unit according to claim 1, further comprising an oil pit arranged to receive oil dropped from an area outside the peripheral wall of the clutch rotating body in the radial direction.

4. The marine propulsion unit according to claim 2, wherein the communicating holes are arranged between a topmost clutch plate and a bottom most clutch plate of the plurality of clutch plates.

5. A marine propulsion unit comprising:

a case arranged to be supported by a hull;

a propeller supported in a lower portion of the case;

an upper planetary gear train disposed above a lower planetary gear train in the case and arranged to receive an engine output, to change the speed of the output, and to transmit the output to the propeller;

an oil pan disposed below the upper planetary gear train and the lower planetary gear train to store lubricating oil for each of the planetary gear trains; and an oil return passage arranged to return the oil that has lubricated the upper planetary gear train to the oil pan while avoiding the lower planetary gear train.

6. The marine propulsion unit according to claim 5, wherein the oil return passage is arranged in a side portion of a transmission case that covers the lower planetary gear train housed in the case.

7. The marine propulsion unit according to claim 5, wherein the upper planetary gear train and the lower planetary gear train are disposed on a same axis that extends in a vertical direction;

an oil supply passage is arranged to extend along the axis of the upper planetary gear train; and the lubricating oil is supplied to the lower planetary gear train through the oil supply passage.

8. The marine propulsion unit according to claim 6, further comprising:

right and left front bolts that vertically extend to fasten a front portion of the transmission case to the case; and right and left rear bolts that vertically extend to fasten a rear portion of the transmission case to the case; wherein a width dimension between the right front bolt and the left front bolt is larger than a width dimension between the right rear bolt and the left rear bolt in a width direction of the hull.

9. The marine propulsion unit according to claim 6, further comprising a cooling water passage arranged in the side portion of the transmission case and radially outside of the oil return passage.

10. The marine propulsion unit according to claim 9, wherein a cross-sectional area of the cooling water passage is larger than a cross-sectional area of the oil return passage in a plan sectional view of the transmission case.

11. The marine propulsion unit according to claim 10, wherein the cooling water passage and the oil return passage have arc shapes that follow a lateral wall of the transmission case;

the transmission case and the lower planetary gear train share a common axis extending in the vertical direction; and the arc of the cooling water passage around the axis is longer than the arc of the oil return passage in the plan sectional view of the transmission case.

12. A marine propulsion unit comprising:

a case arranged to be supported by a hull;

a swivel bracket provided on a front portion of the case and arranged to pivotally support the case on the hull;

a propeller supported in a lower portion of the case; and a transmission unit housed in the case and arranged to receive an engine output, to change the speed of the output, and to transmit the output to the propeller, wherein the transmission unit includes:

a cylindrically-shaped transmission case with an outer shell and having an axis extending in a vertical direction;

a transmission housed in the transmission case to change the speed of the output;

an oil pan arranged in a bottom portion of the transmission case;

an inlet port disposed in a front portion of the oil pan, the front portion of the oil an is a portion of the oil an located closest to the front portion of the case;

an oil pump provided in an upper portion of the transmission case;

an oil inlet passage which communicates the inlet port with an inlet section of the oil pump; and an oil supply passage that communicates a discharge section of the oil pump with a section to be supplied with oil.

13. The marine propulsion unit according to claim 12, wherein the bottom portion of the transmission case is separately provided from an upper portion thereof and is detachably secured to the upper portion.

14. The marine propulsion unit according to claim 13, wherein the inlet port is detachable from a lower surface of the upper portion of the transmission case such that the bottom portion of the transmission case is detached from the upper portion thereof.

15. The marine propulsion unit according to claim 12, wherein at least one of the oil inlet passage and the oil supply passage is arranged in either a right or a left side portion of the transmission case; and an oil return passage, through which oil having been supplied to the oil supplied section is returned to the oil pan, is arranged in the other side of the right and left side portion of the transmission case.

16. The marine propulsion unit according to claim 15, wherein a cross-section of the oil return passage has a curved shape arranged to follow a cross-sectional shape of the transmission case in a plan sectional view of the transmission unit.

17. The marine propulsion unit according to claim 12, further comprising a cooling water passage arranged in the bottom portion of the transmission case.

* * * * *